US011109671B1

(12) United States Patent
Liu

(10) Patent No.: US 11,109,671 B1
(45) Date of Patent: Sep. 7, 2021

(54) HEIGHT-ADJUSTABLE TABLE STRUCTURE

(71) Applicant: C.D. Great Furniture Co., Ltd., Taichung (TW)

(72) Inventor: Tseng-Lang Liu, Taichung (TW)

(73) Assignee: C.D. Great Furniture Co., Ltd., Taichung (TW)

( * ) Notice: Subject to any disclaimer, the term of this patent is extended or adjusted under 35 U.S.C. 154(b) by 0 days.

(21) Appl. No.: 16/893,062

(22) Filed: Jun. 4, 2020

(51) Int. Cl.
*A47B 9/16* (2006.01)

(52) U.S. Cl.
CPC ..... *A47B 9/16* (2013.01); *A47B 2200/006* (2013.01)

(58) Field of Classification Search
CPC ..... A47B 9/16; A47B 2009/145; B66F 7/065; B66F 7/0658; B66F 7/0666; B66F 3/22; B66F 1/06; B66F 7/12
USPC ..... 108/145; 254/122, 124
See application file for complete search history.

(56) References Cited

U.S. PATENT DOCUMENTS

| | | | | |
|---|---|---|---|---|
| 7,246,784 | B1 * | 7/2007 | Lopez | A47B 51/00 108/145 |
| 10,092,089 | B1 * | 10/2018 | Yuan | A47B 3/002 |
| 10,258,148 | B1 * | 4/2019 | Donner | A47B 9/18 |
| 10,893,748 | B1 * | 1/2021 | Poniatowski | A47B 21/0314 |
| 2002/0078866 | A1 * | 6/2002 | Palmer | A47G 21/08 108/145 |
| 2014/0264215 | A1 * | 9/2014 | Yustus | B66F 17/00 254/93 R |
| 2018/0008037 | A1 * | 1/2018 | Laudadio | A47B 9/16 |
| 2018/0279770 | A1 * | 10/2018 | Crowe | A47B 21/02 |
| 2019/0038015 | A1 * | 2/2019 | Huang | A47B 9/02 |
| 2020/0231079 | A1 * | 7/2020 | Lai | B66F 5/04 |
| 2020/0298599 | A1 * | 9/2020 | Tsuchiya | B41J 29/06 |

FOREIGN PATENT DOCUMENTS

| | | | | |
|---|---|---|---|---|
| CA | 2885812 | A1 * | 9/2015 | A47B 3/0818 |
| DE | 202016102015 | U1 * | 5/2016 | A47B 9/02 |
| DE | 202016106868 | U1 * | 12/2016 | A47B 9/02 |
| TW | M526853 | U | 8/2016 | |
| WO | WO-2017045506 | A1 * | 3/2017 | A47B 21/02 |

* cited by examiner

*Primary Examiner* — Jose V Chen
(74) *Attorney, Agent, or Firm* — Wang Law Firm, Inc.

(57) ABSTRACT

A height-adjustable table structure includes: a tabletop, a first support frame, a second support frame, a first spring, an adjustment unit, a linkage group, and a positioning member. The adjustment member is disposed to the top surface of the tabletop for the user to observe. When the adjustment member is driven to move, the locking member of the linkage group is moved from the locking position to the releasing position, so that the first and support frames are free to rotate. When the adjustment member is released, the locking member will be moved from the releasing position to the locking position, so as to maintain the adjusted height of the table structure. By such arrangements, during the height adjustment of the table structure, the user can clearly see the position of the adjustment member, leading to more intuitive use, achieving easy operation and improved safety.

8 Claims, 24 Drawing Sheets

HEIGHT-ADJUSTABLE TABLE STRUCTURE

BACKGROUND

Field of the Invention

The present invention relates to a table structure, and more particularly to a height-adjustable table structure.

Related Prior Art

Please refer to FIG. 1, which shows a structure of an adjustable lifting table of the Taiwan Patent (M526853). The adjustable lifting structure includes a tabletop 1, a base 2 and an adjustment mechanism 3. The adjustment mechanism 3 includes two opposite scissor stands 4, the tops of the two scissor stands 4 are fixed to the bottom surface of the tabletop 1, and the bottoms of the two scissor stands 4 are movably assembled to the base 2. The two scissor stands 4 are respectively provided with an adjusting portion 5 on the top, and a handle 6 located below the tabletop 1 is extended from one side of each of the adjusting portions 5. The user can drive the two scissor stands 4 to move up and down via the two handles 6, thus adjusting the height of the lifting table.

However, the positions of the two handles 6 are located under the tabletop 1. When the user wants to adjust the height of the lifting table, because the position of the two handles 6 cannot be seen clearly, the user can only use the memory to explore or randomly explore them, and sometimes needs to bend down to find them, resulting in considerable inconvenience in operation and even danger, such as: a finger touches a sharp object and is injured.

The present invention has arisen to mitigate and/or obviate the afore-described disadvantages.

SUMMARY

One objective of the present invention is to provide a height-adjustable table structure, capable of enabling the user to clearly see the position of the adjustment member of the table structure, which is more intuitive in use, and achieves the purposes of easy operation and improved safety.

To achieve the above objective, a height-adjustable table structure provided by the invention comprises: a tabletop including a top surface and a bottom surface opposite to the top surface; at least one adjustment unit disposed to the tabletop, and including: an adjustment member penetrating the top surface for a user to observe, and a driven member driven to move by the adjustment member, wherein the adjustment member is movable between a first position and a second position; at least one linkage group disposed on the bottom surface of the tabletop, and including: a transmission rod and at least one locking member, wherein the transmission rod is rotatable disposed on the bottom surface of the tabletop and capable of returning to its original position, and includes: a first rod portion connected to the driven member and driven by the driven member to move, and a second rod portion, the at least one locking member is pivotally disposed to the second rod portion and capable of moving between a releasing position and a locking position; at least one positioning member disposed on the bottom surface of the tabletop and movable along a horizontal direction relative to the tabletop while the tabletop moves along a longitudinal direction relative to the base frame, wherein the at least one positioning member includes a greater number of positioning grooves than an amount of the at least one locking member, and the positioning grooves are used for inserting or detaching of the at least one locking member;

when the adjustment member moves from the first position to the second position, the adjustment unit drives the transmission rod to rotate in a first direction (e.g. a clockwise direction) by an angle and accumulates a restoring force, and meanwhile, the at least one locking member is driven to move from the locking position to the releasing position to allow the at least one locking member to be disengaged from the positioning grooves of the at least one positioning member; and then, while the tabletop moves in the longitudinal direction, the at least one positioning member moves relative to the at least one locking member in the horizontal direction, and when the adjustment member is released, the transmission rod is driven by the restoring force to rotate in a second direction (e.g. a counterclockwise direction) opposite to the first direction by an angle, so that the adjustment member is moved from the second position to the first position, and the at least one locking member is moved from the releasing position to the locking position, enabling the at least one locking member to be inserted into the positioning grooves of the at least one positioning member.

By such arrangements, the present invention provides a height-adjustable table structure, which is characterized in that the adjustment member is disposed on the top surface of the tabletop for the user to observe, so that the user can clearly see the position of the adjustment member, which is more intuitive in use, achieving the purpose of easy operation and improved safety.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

DETAILED DESCRIPTION

Figure 1:
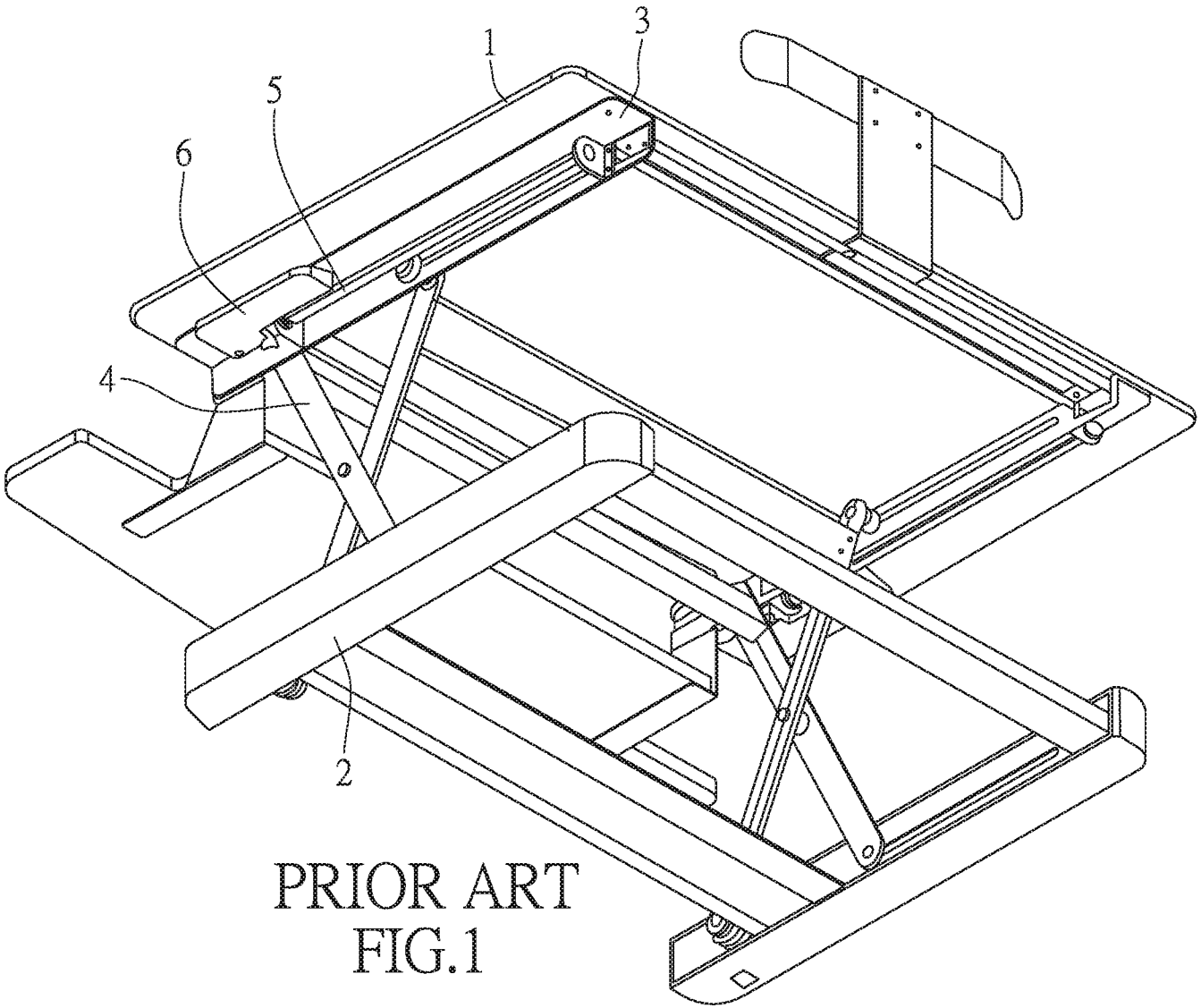
PRIOR ART FIG.1
FIG. 1 is one of the drawings of the Taiwan Patent (M526853) showing a height adjustable table.
Figure 2:
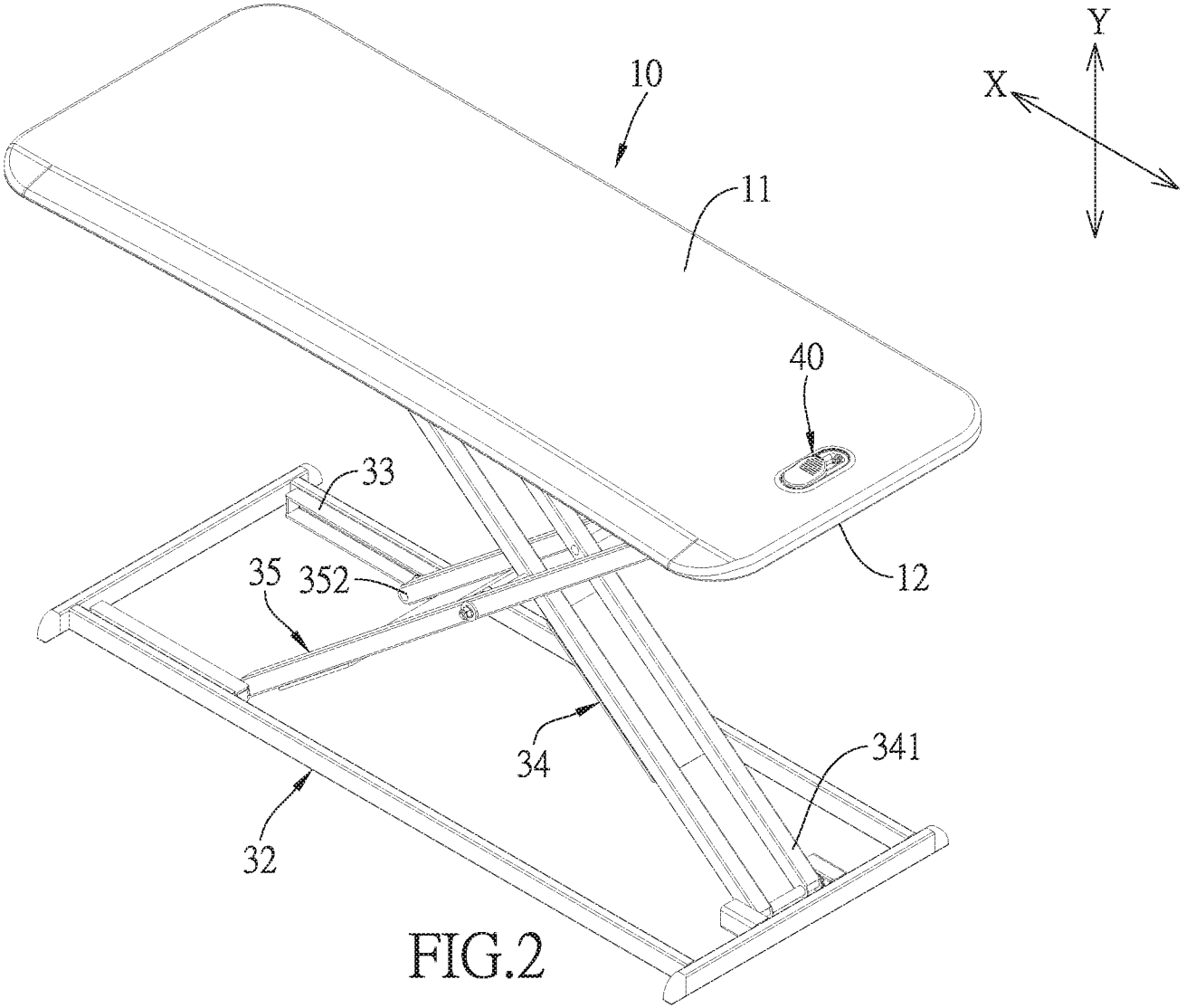
FIG. 2 is a perspective view of a first embodiment of the present invention.
Figure 3:
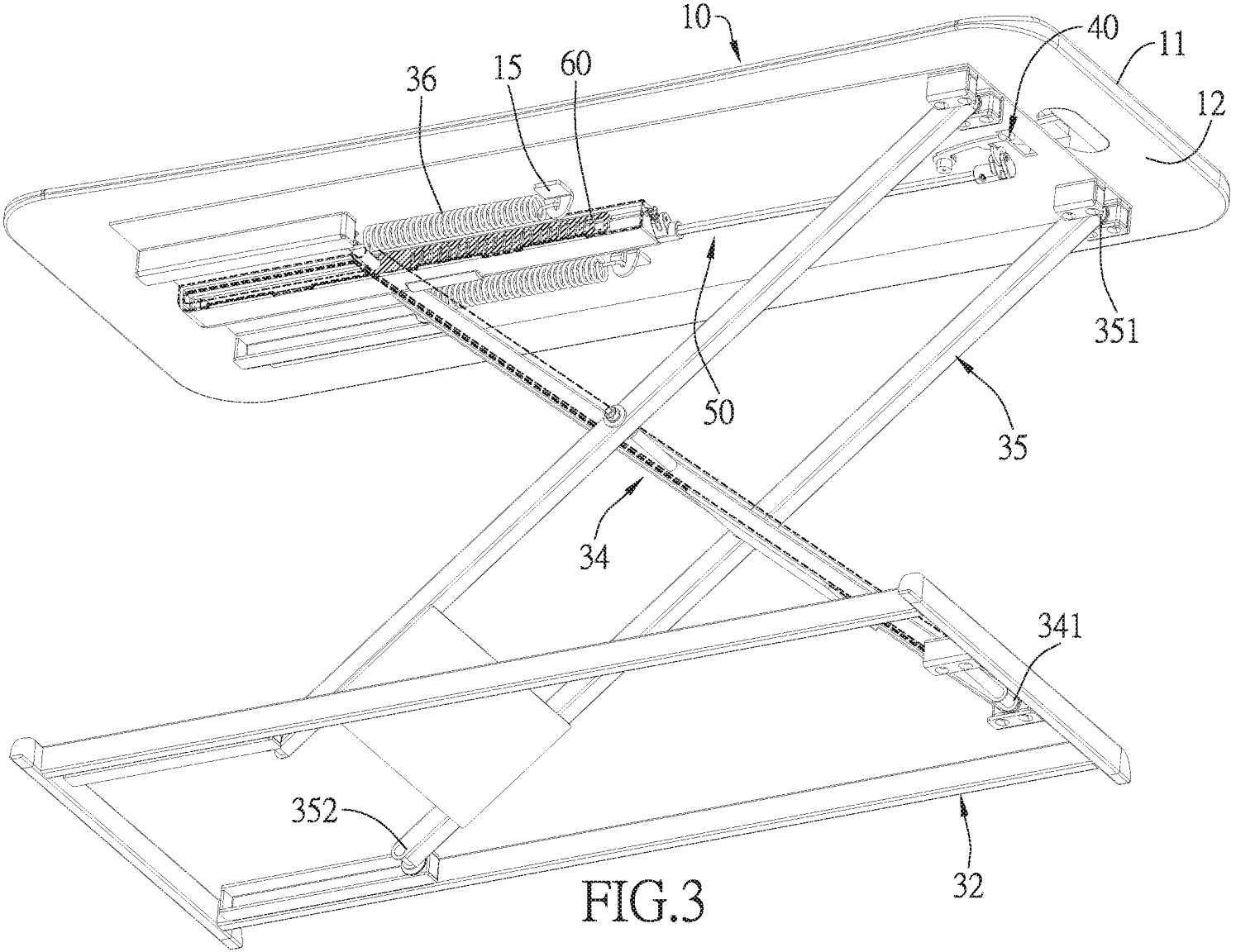
FIG. 3 is a perspective view of the first embodiment of the present invention at another view point.
Figure 4:
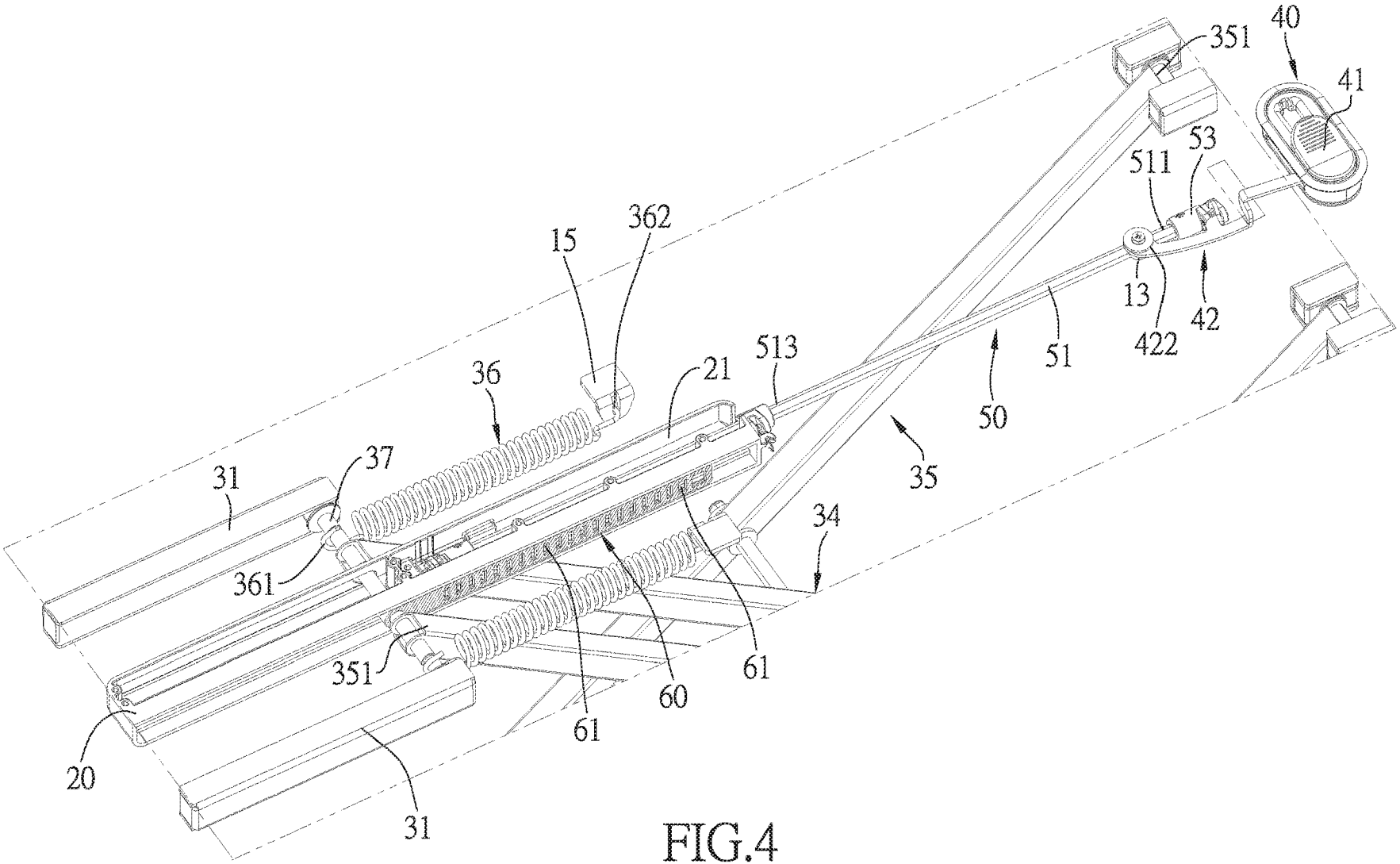
FIG. 4 is a magnified perspective view of a part of the first embodiment of the present invention.
Figure 5:
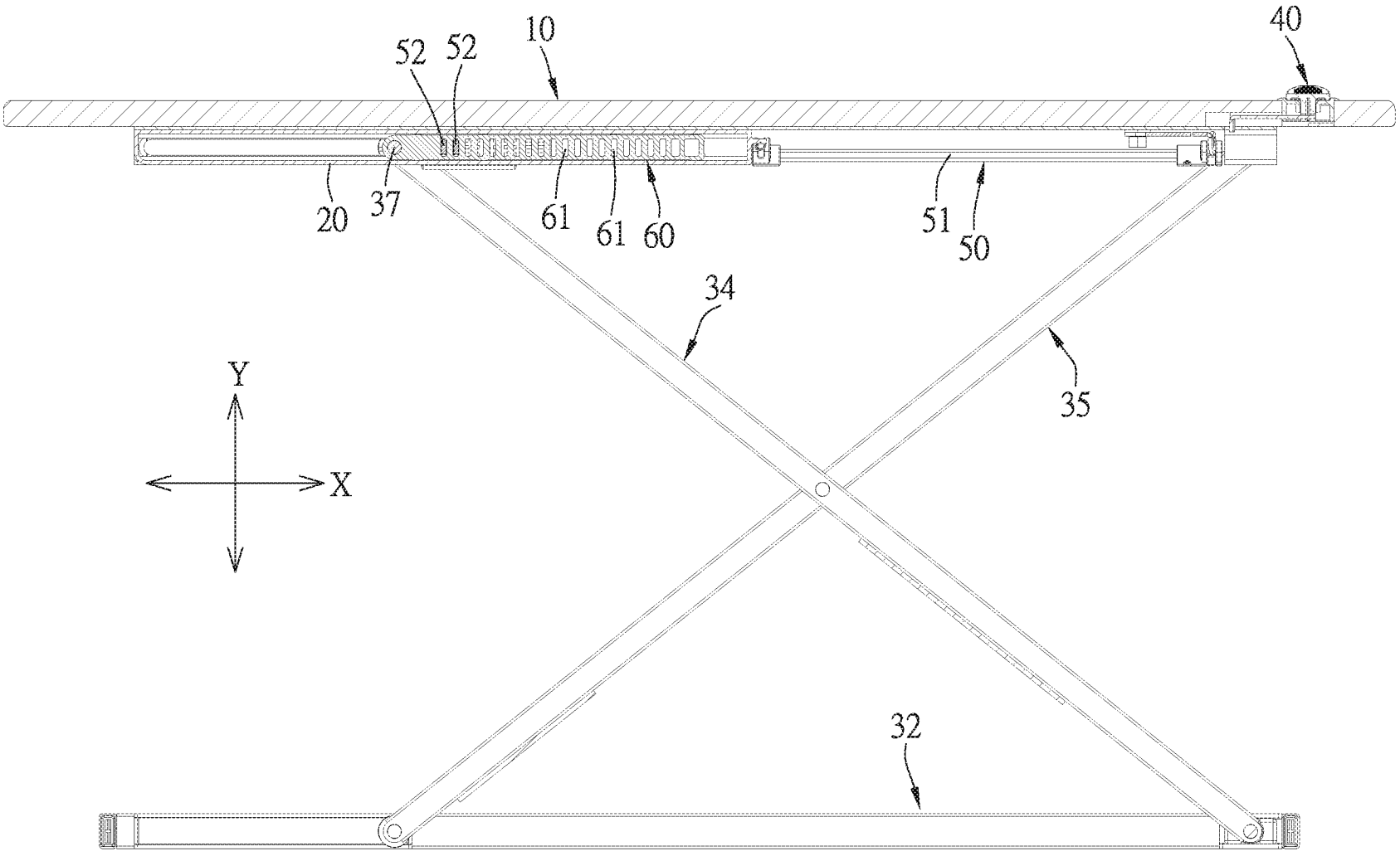
FIG. 5 is a side view of the first embodiment of the present invention, showing the state of the table whose height has not been adjusted yet.
Figure 6:
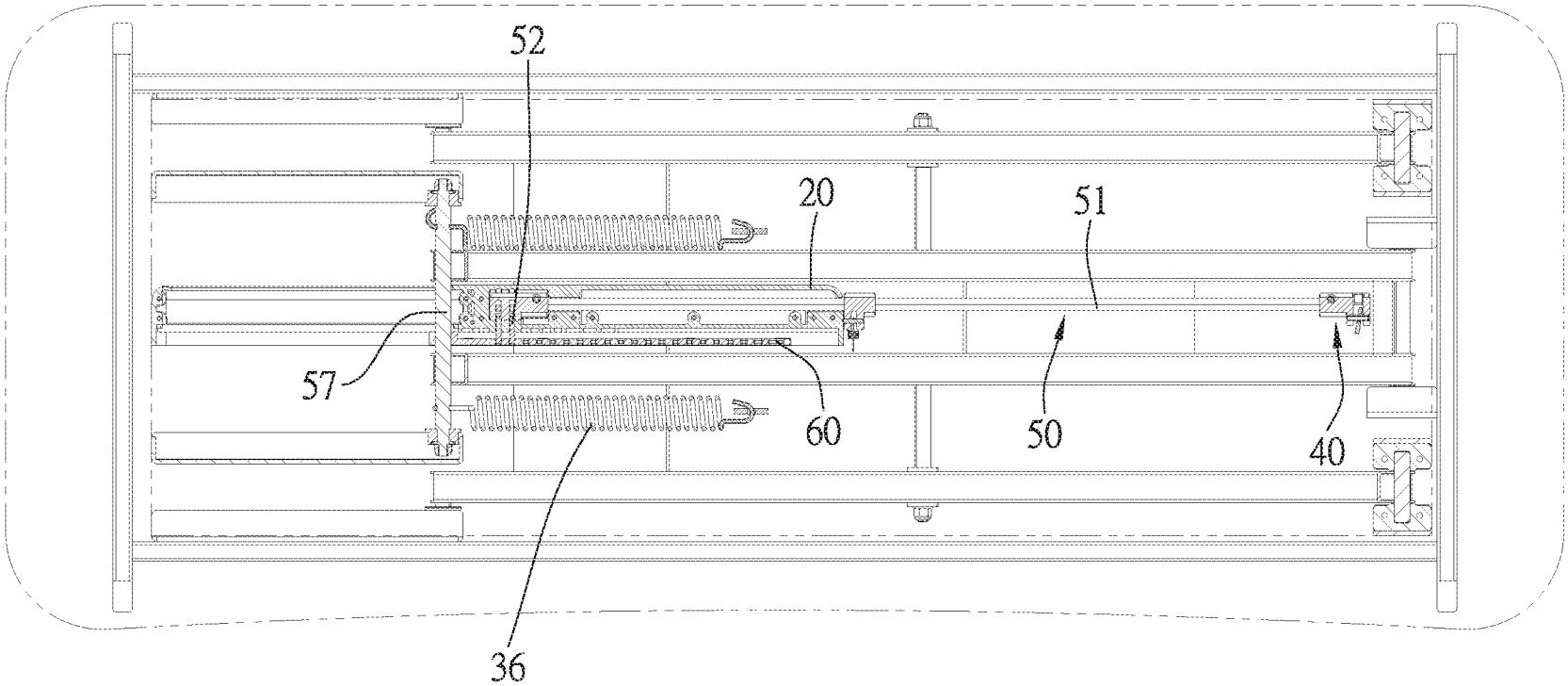
FIG. 6 is a top view of the first embodiment of the present invention.
Figure 7:
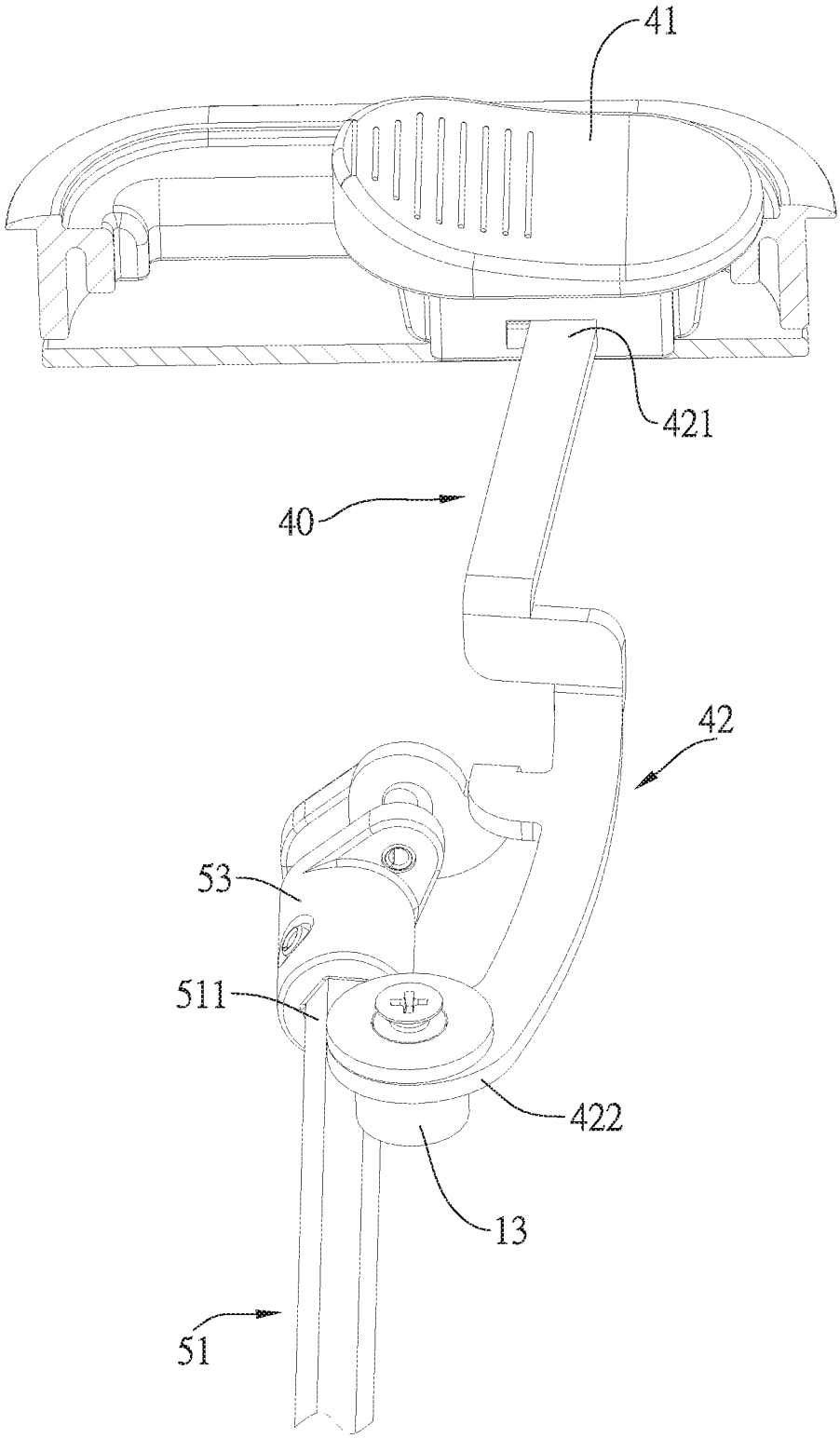
FIG. 7 is a schematic diagram of the operation of the first embodiment of the present invention, showing the state of the adjustment member in the first position.

The present invention will be clearer from the following description when viewed together with the accompanying drawings, which show, for purpose of illustrations only, the preferred embodiment in accordance with the present invention.

Before proposing a detailed description, it should be noted that in the following description, similar component and part names are represented by the same numbers.

Referring to FIGS. 2-13, a height-adjustable table structure provided by the first embodiment of the present invention essentially comprises: a tabletop 10, a limiting seat 20, two upper sliding seats 31, a base frame 32, two lower sliding seats 33, a first support frame 34, a second support frame 35, two first springs 36, an adjustment unit 40, a linkage group 50, and a positioning member 60.

The tabletop 10 has a top surface 11 and a bottom surface 12 opposite to the top surface 11. The height direction of the tabletop 10 in which the tabletop 10 is adjusted is defined as a longitudinal direction Y, and the tabletop 10 further has a horizontal direction X perpendicular to the longitudinal direction Y.

The limiting seat 20 is fixed to the bottom surface 12 of the tabletop 10 and includes a receiving groove 21.

The two upper sliding seats 31 are fixed to the bottom surface 12 of the tabletop 10 and respectively located at two sides of the limiting seat 20.

The base frame 32 is located below the bottom surface 12 of the tabletop 10 and at a distance from the tabletop 10.

The two lower sliding seats 33 are fixed to two sides of the base frame 32.

The first support frame 34 includes a first lower support end 341 pivotally disposed to the base frame 32, and a first upper support end 342 slidably disposed to the two upper sliding seats 31. In this embodiment, the first upper support end 342 is slidably disposed to the two upper sliding seats 31 by a connecting rod 37 penetrating the receiving groove 21.

The second support frame 35 is pivotally connected to the first support frame 34 to form an X shape with the first support frame 34. The second support frame 35 further includes a second upper support end 351 pivotally disposed on the bottom surface 12 of the tabletop 10 and a second lower support end 352 slidably disposed to the two lower sliding seats 33.

The two first springs 36, each of which includes a first extension end 361 provided on the connecting rod 37 of the first support frame 34, and a second extension end 362 fixed to the bottom surface 12 of the tabletop 10 through a fixing piece 15, so as to provide a force for keeping the tabletop 10 moving upward.

Figure 8:
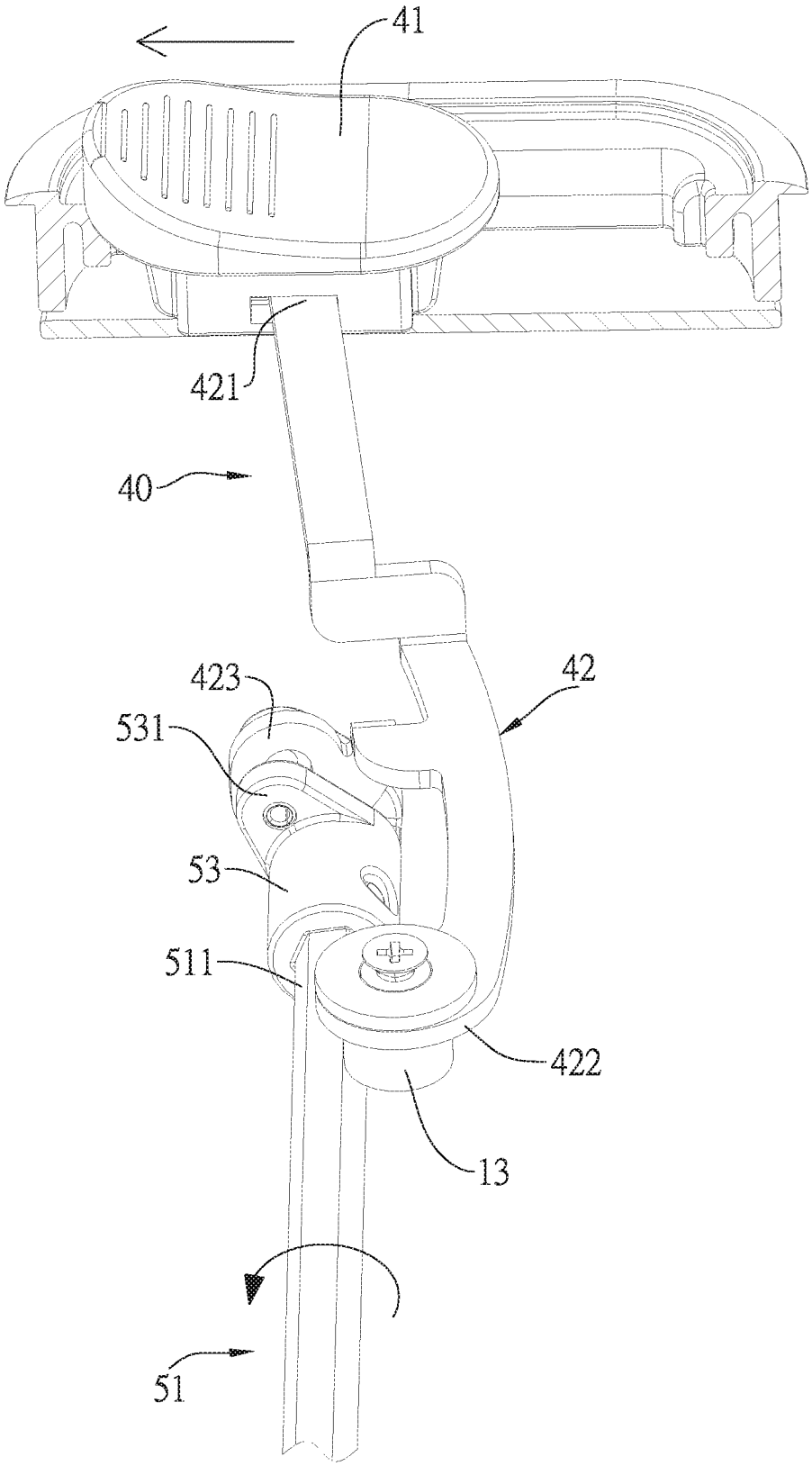
FIG. 8 is a schematic diagram of the operation of the first embodiment of the present invention, showing the state of the adjustment member in the second position.

The adjustment unit 40 is disposed to the tabletop 10, and includes: an adjustment member 41 penetrating the top surface 11 for a user to observe, and a driven member 42 driven by the adjustment member 41 to move. The adjustment member 41 can be movable between a first position (FIG. 7) and a second position (FIG. 8). In this embodiment, the driven member 42 is an integrally formed unitary structure, and includes: a first portion 421 connected to the adjustment member 41, a second portion 422 pivotally disposed to the bottom surface 12 of the tabletop 10, and a third portion 423 located between the first portion 421 and the second portion 422. In this embodiment, the bottom surface 12 of the tabletop 10 is provided with a hinge 13, and the second portion 422 is pivotally disposed to the hinge 13, so that the driven member 42 and the tabletop 10 are pivotally connected to each other.

The linkage group 50 is disposed on the bottom surface 12 of the tabletop 10, and includes: a transmission rod 51 and two locking members 52. The transmission rod 51 is rotatably disposed to the bottom surface 12 of the tabletop 10 and capable of returning to its original position, and includes: a first rod portion 511 connected to the driven member 42 and driven by the driven member 42 to move, a second rod portion 512, and a third rod portion 513 between the first rod portion 511 and the second rod portion 512. In this embodiment, the first rod portion 511 is provided with a front eccentric block 53 which is fixed thereto and has a front eccentric portion 531. The front eccentric portion 531 is not on an axis of the transmission rod 51, and is drivingly connected to the third portion 423 of the adjustment member 41, so that the transmission rod 51 can be driven by the adjustment unit 40 to rotate by an angle.

In addition, the third rod portion 513 of the transmission rod 51 is provided with a middle eccentric block 54 having a middle eccentric portion 541 which is not on the axis of the transmission rod 51. The second rod portion 512 of the transmission rod 51 is provided with a rear eccentric block 55 including a rear eccentric portion 551 not on the axis of the transmission rod 51.

Figure 9:
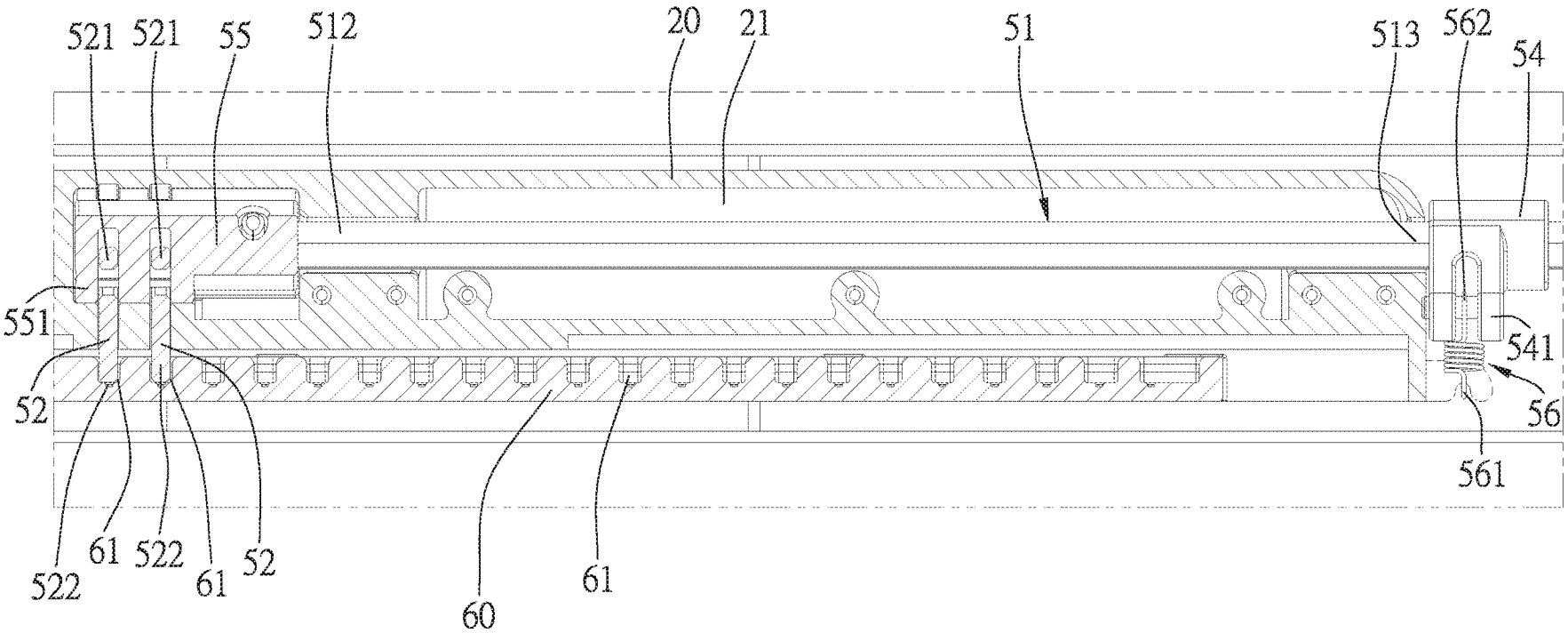
FIG. 9 is a schematic diagram of the operation of the first embodiment of the present invention, showing the state of the locking member in the locking position.
Figure 10:
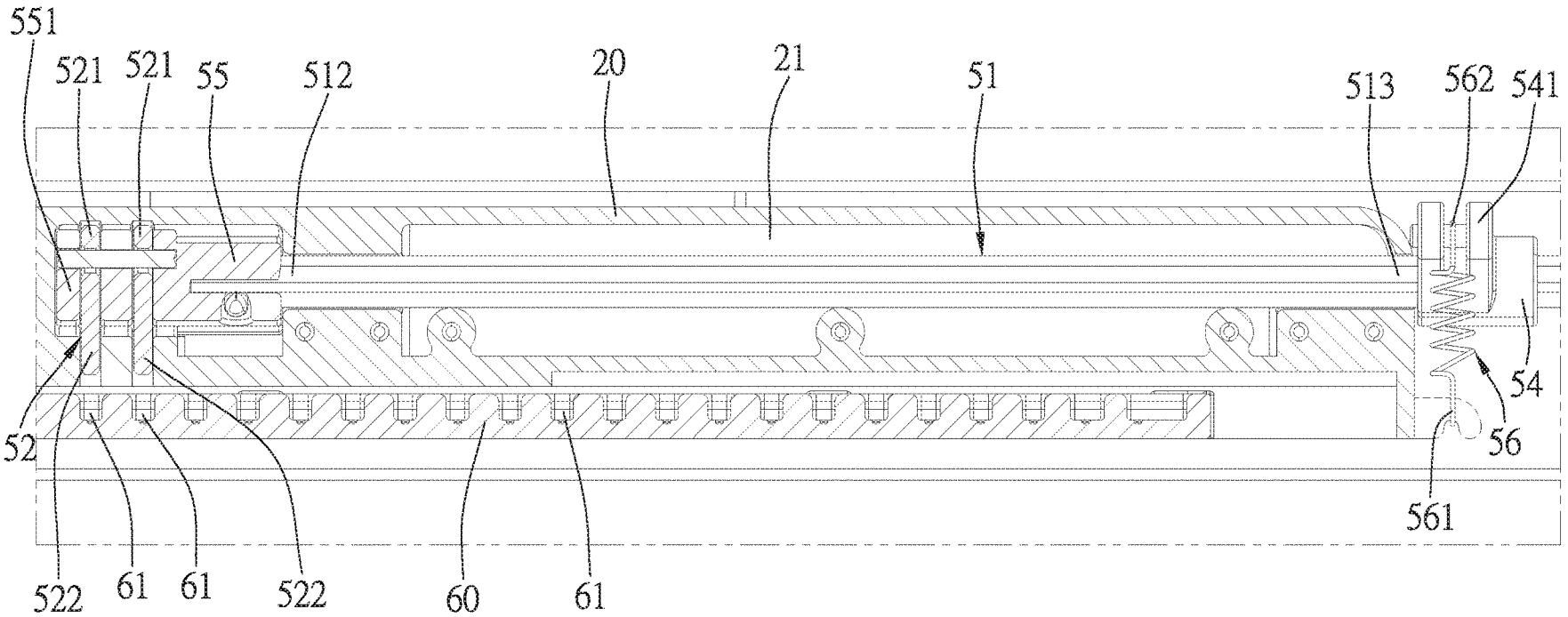
FIG. 10 is a schematic diagram of the operation of the first embodiment of the present invention, showing the state of the locking member in the releasing position.
Figure 11:
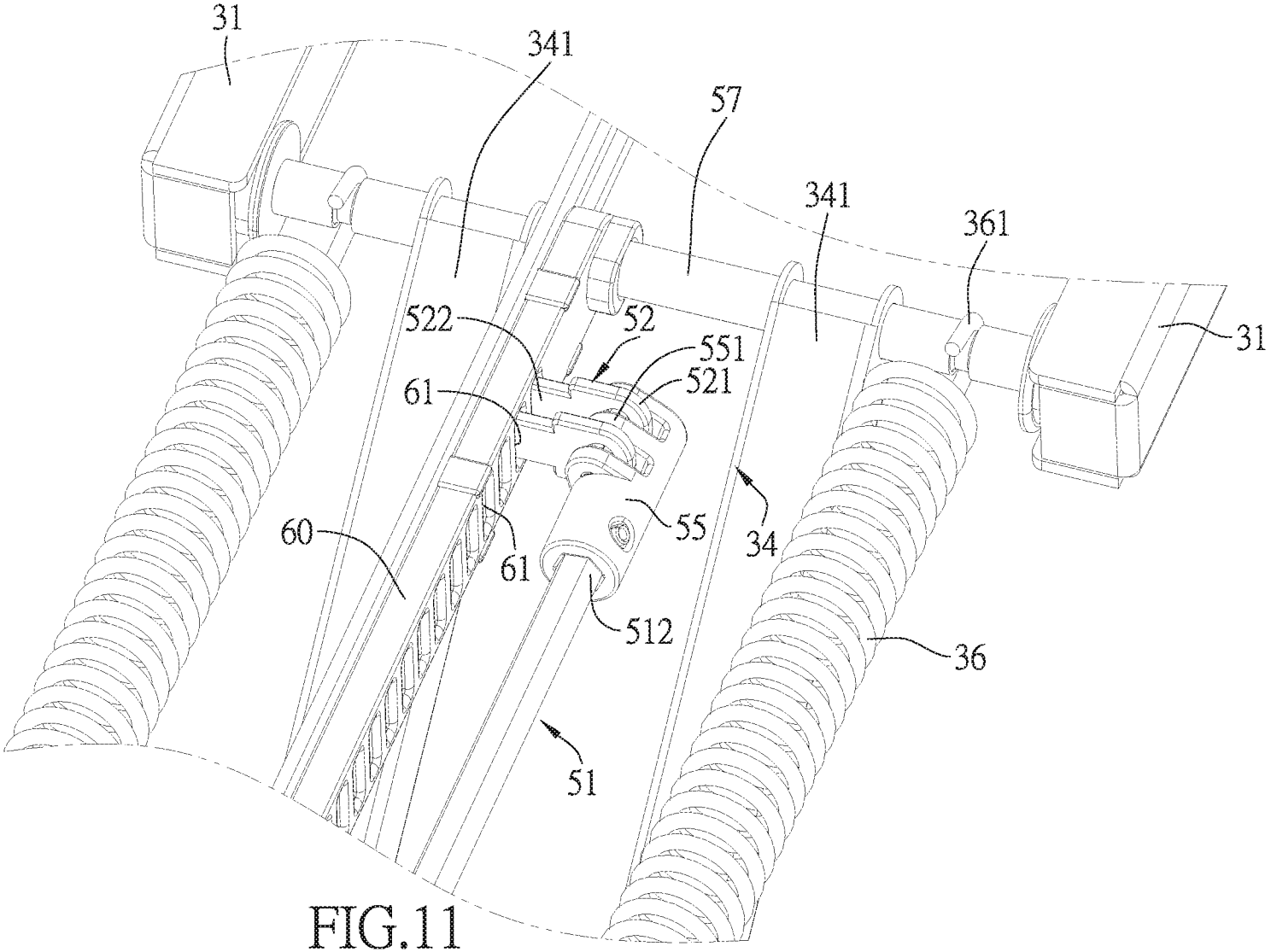
FIG. 11 is a schematic diagram of the operation of the first embodiment of the present invention, showing the locking member in the locking position at another view point.
Figure 12:
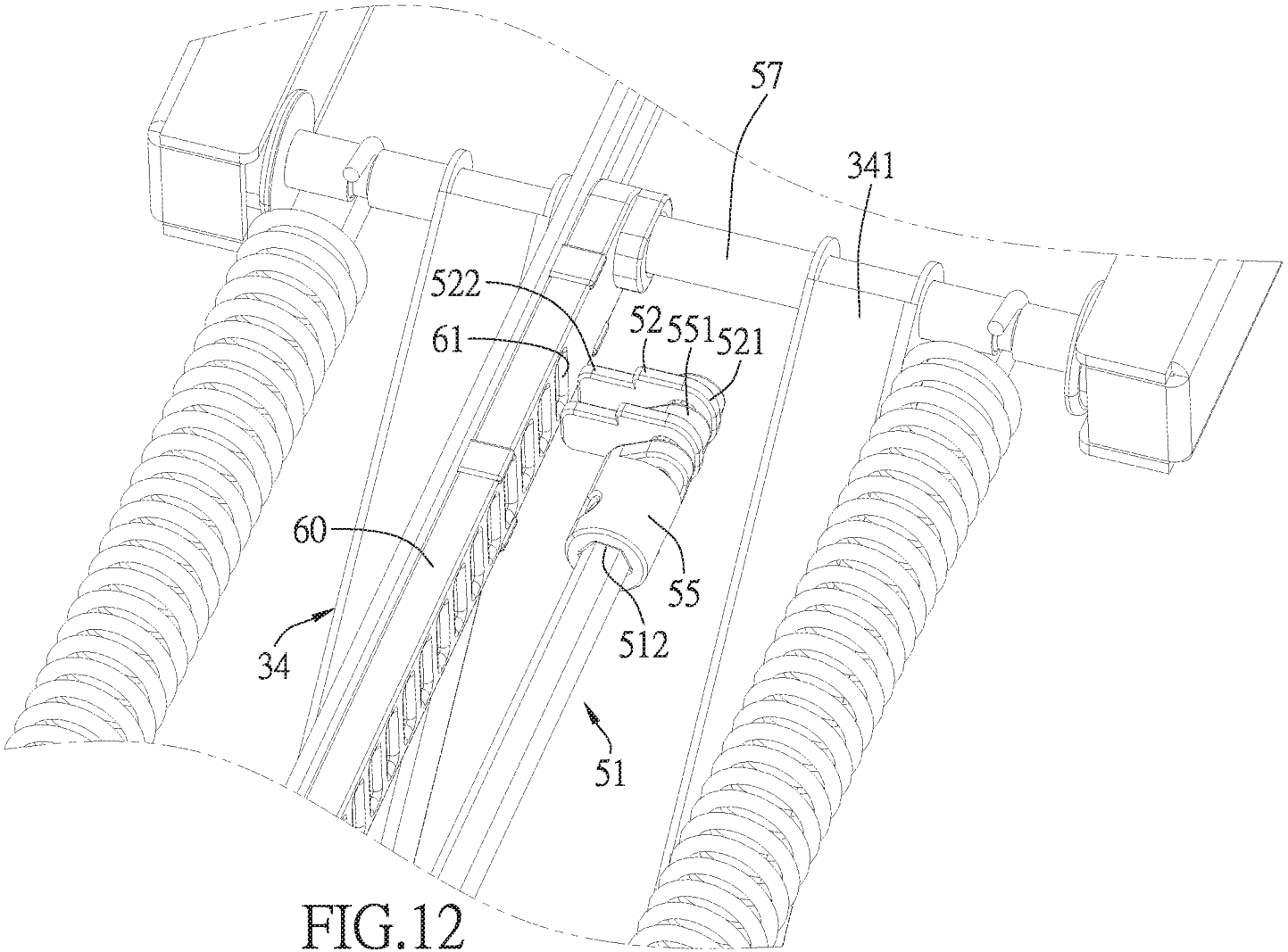
FIG. 12 is a schematic diagram of the operation of the first embodiment of the present invention, showing the locking member in the releasing position at another view point.
Figure 13:
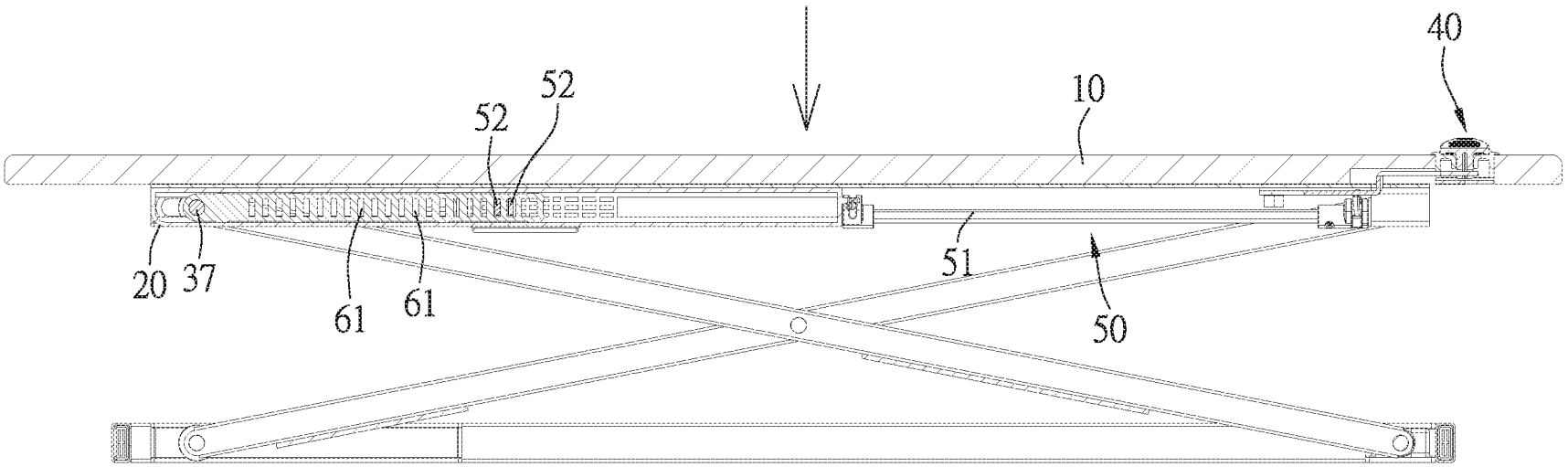
FIG. 13 is a side view of the first embodiment of the present invention, showing the state of the table whose height has been adjusted.
Figure 14:
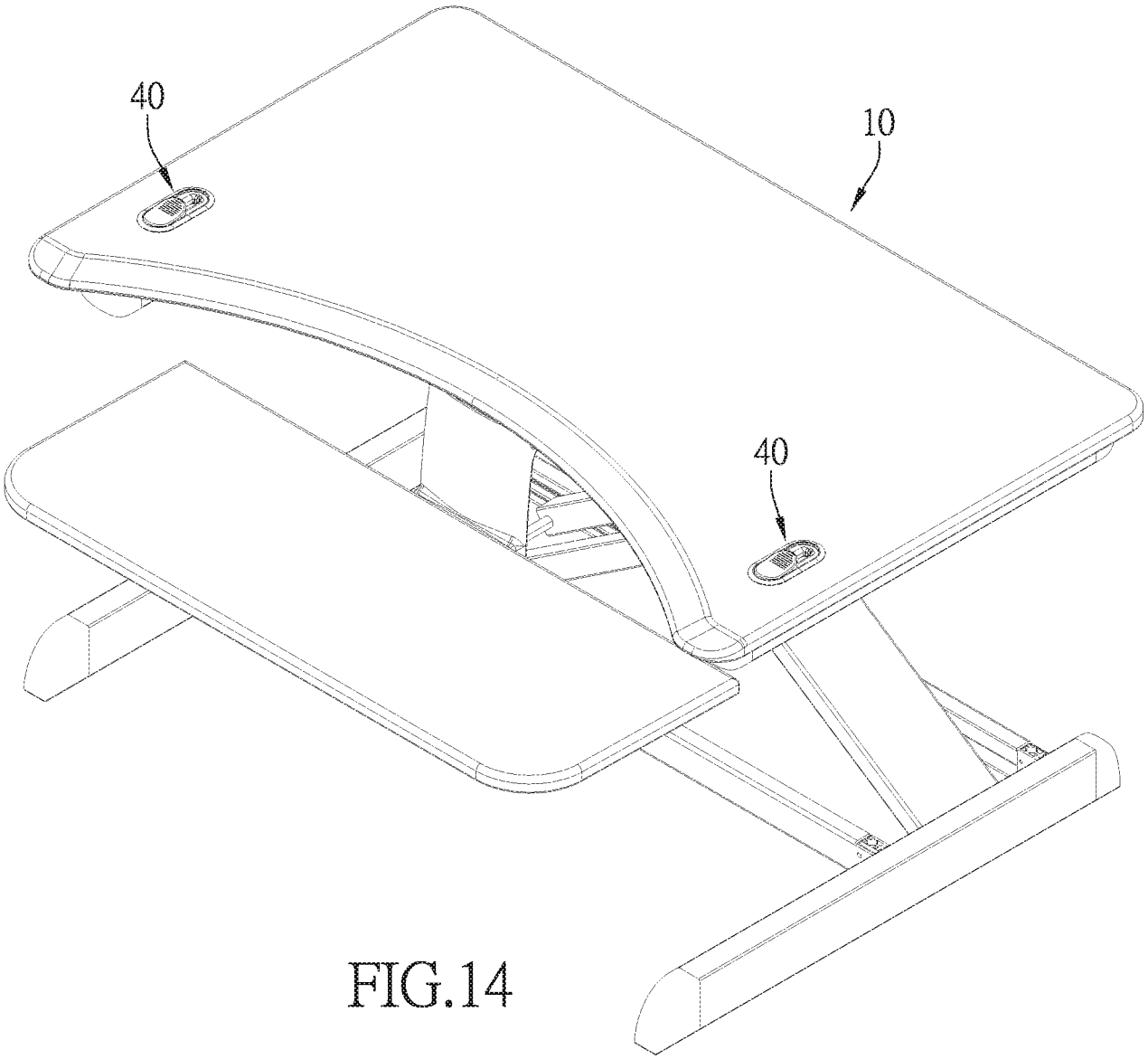
FIG. 14 is a perspective view of a second embodiment of the present invention.
Figure 15:
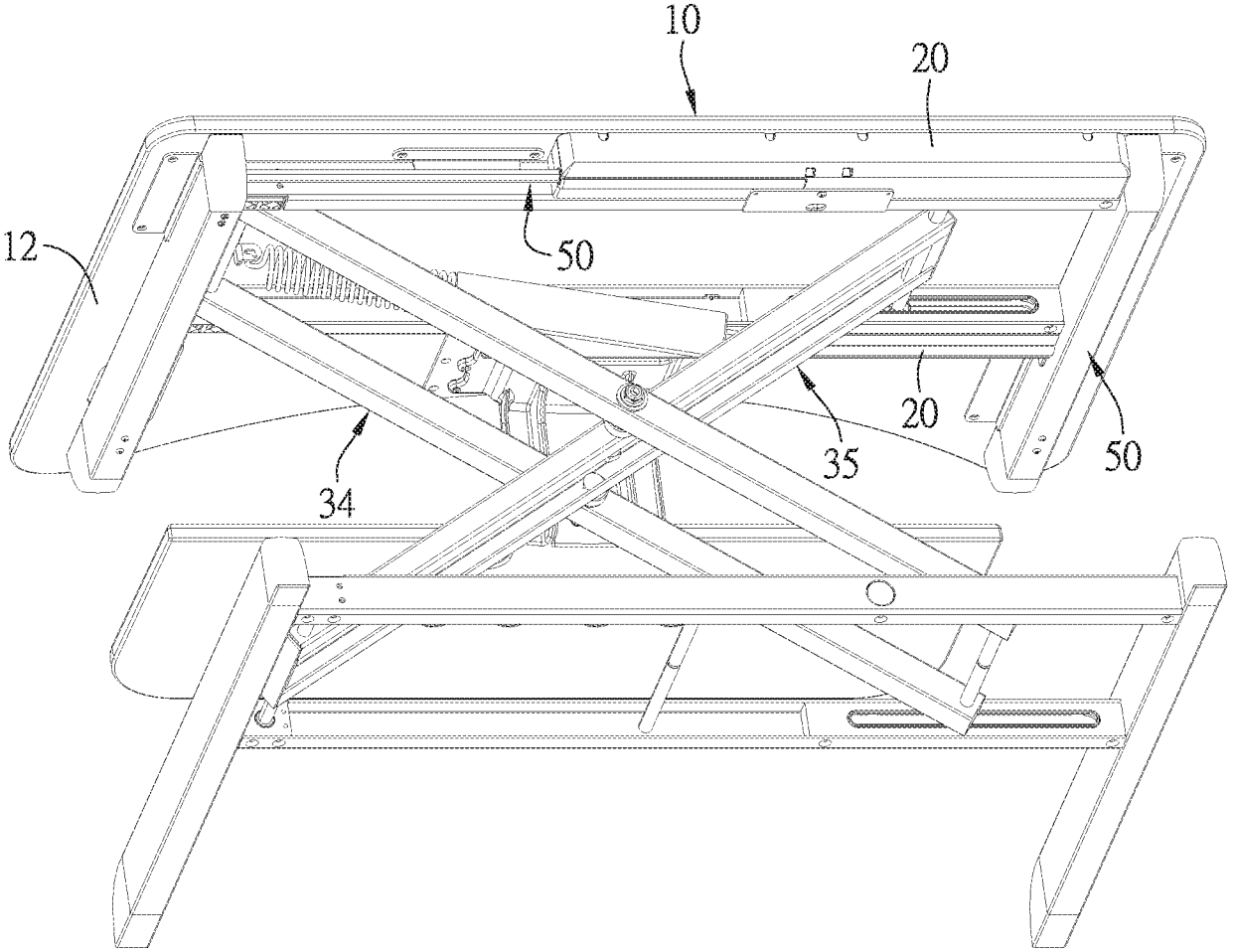
FIG. 15 is a perspective view of the second embodiment of the present invention at another view point.
Figure 16:
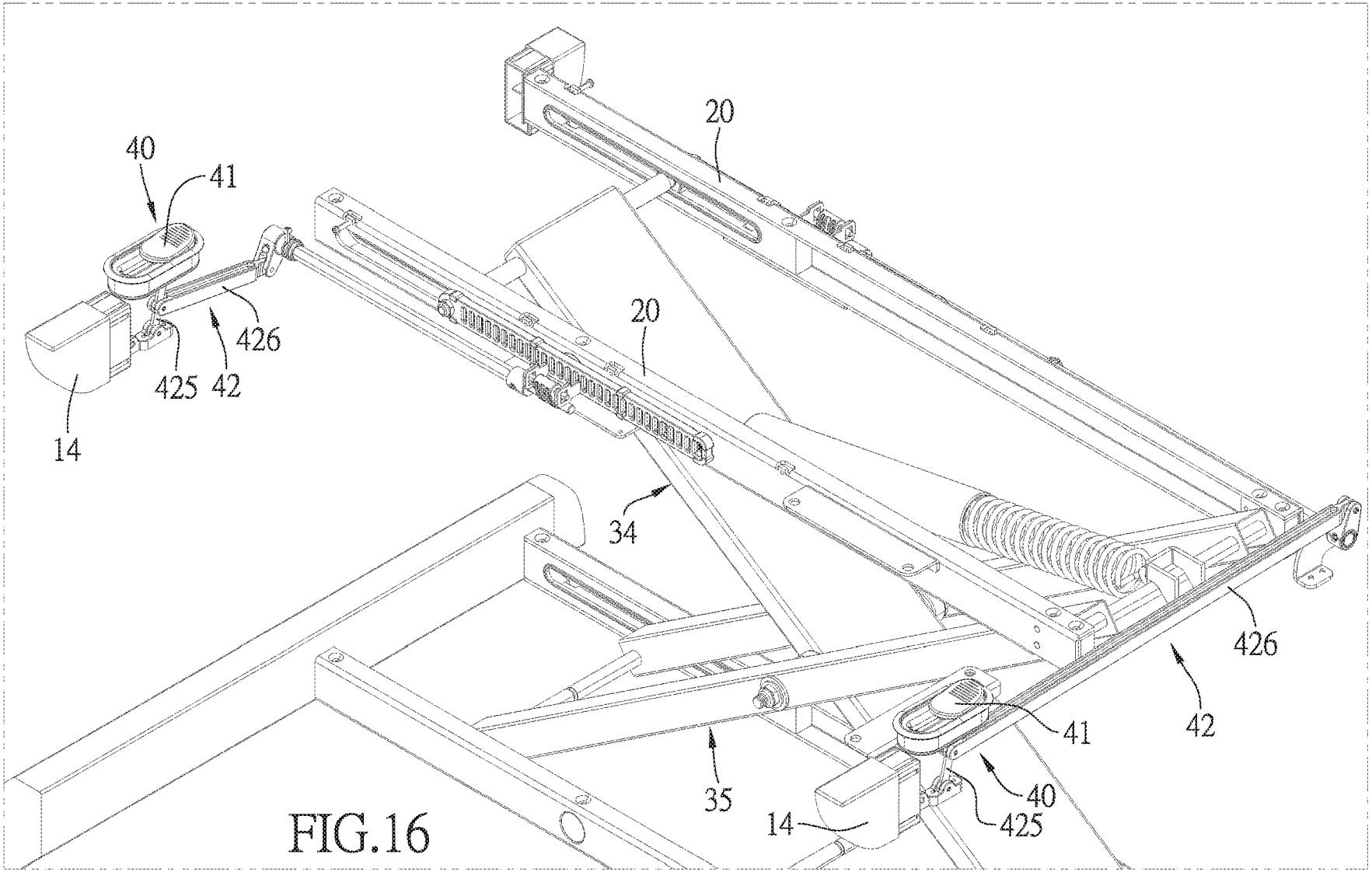
FIG. 16 is a perspective view of the second embodiment of the present invention, showing the state of hiding the tabletop.
Figure 17:
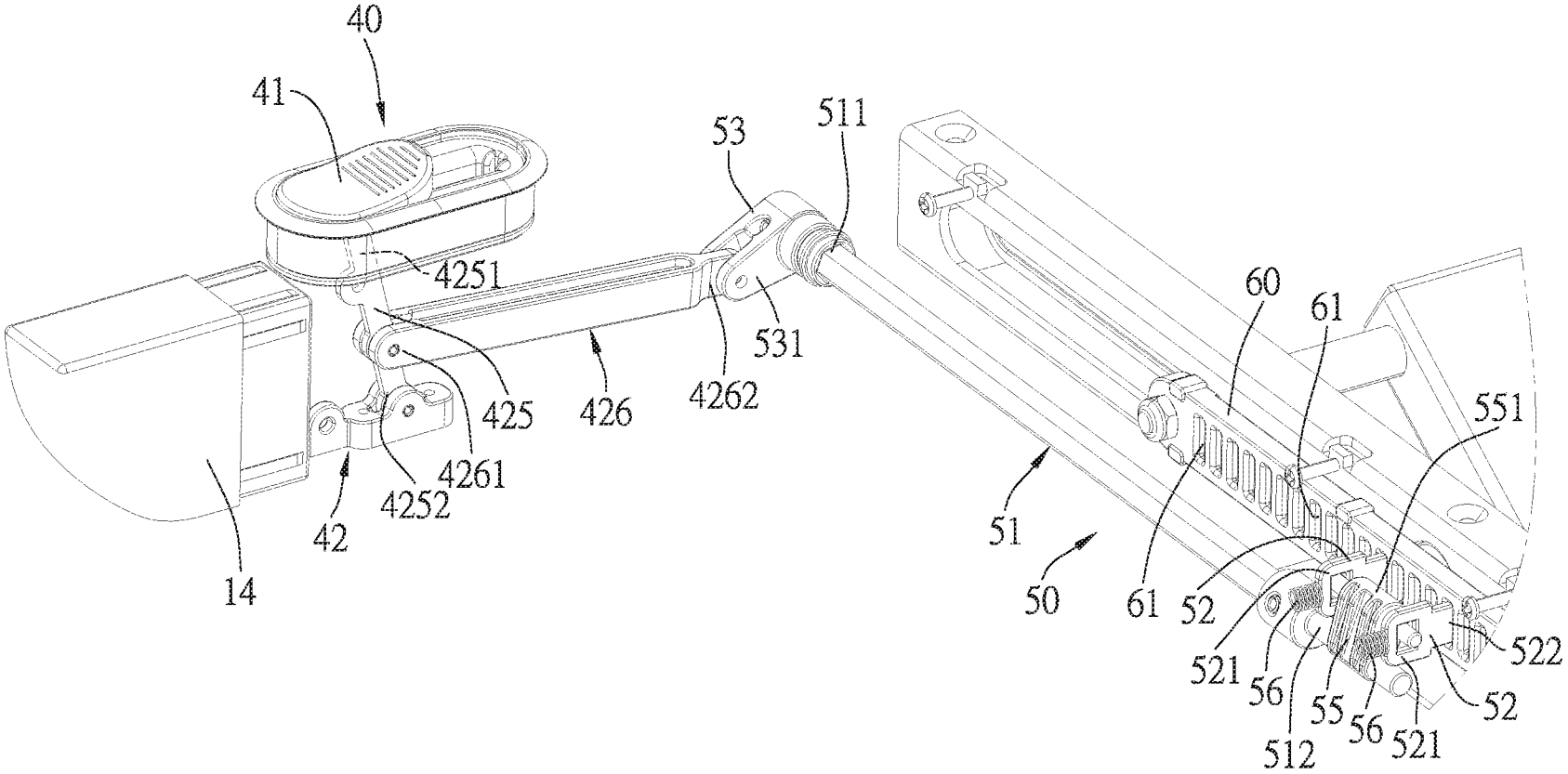
FIG. 17 is a perspective view of a part of the second embodiment of the present invention, showing the state of a group including the limiting seat, the adjustment unit, the linkage group and the positioning member.
Figure 18:
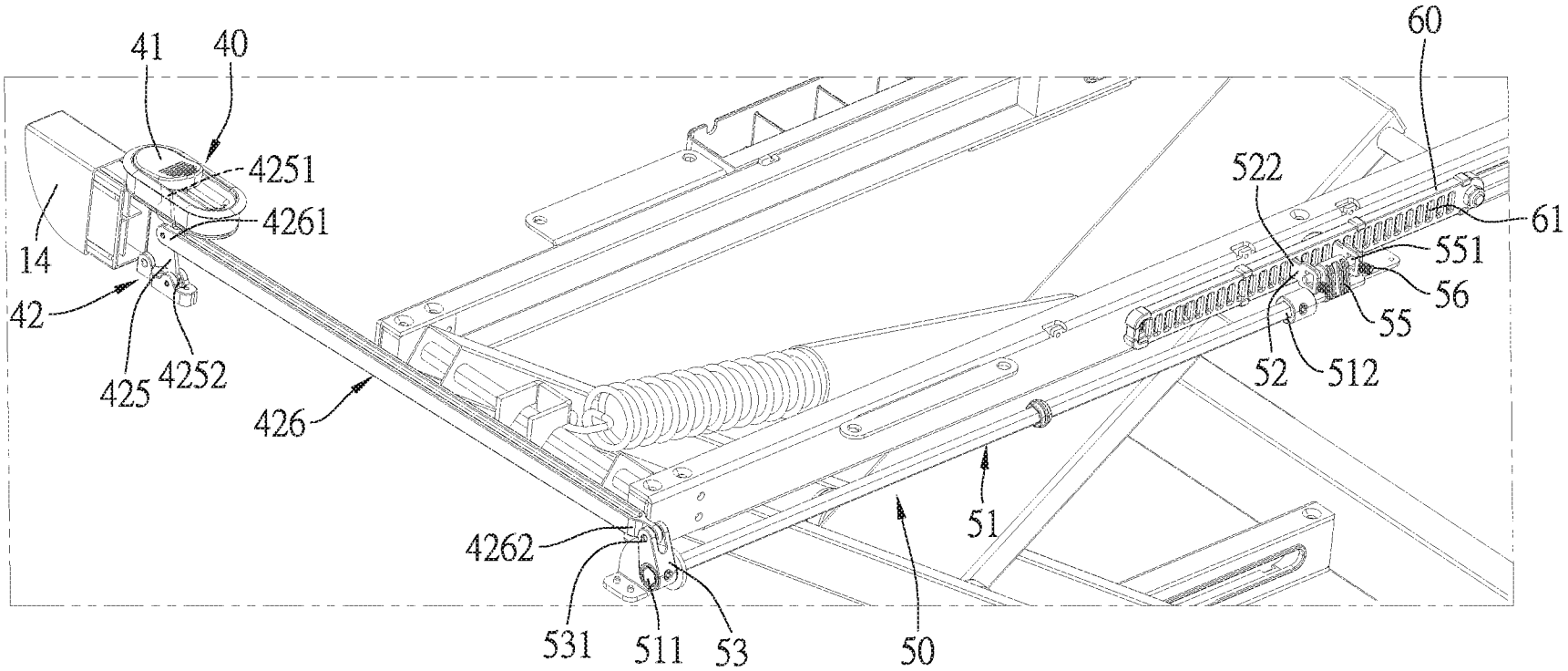
FIG. 18 is a partial perspective view of a part of the second embodiment of the present invention, showing the state of another group including the limiting seat, the adjustment unit, the linkage group and the positioning member.
Figure 19:
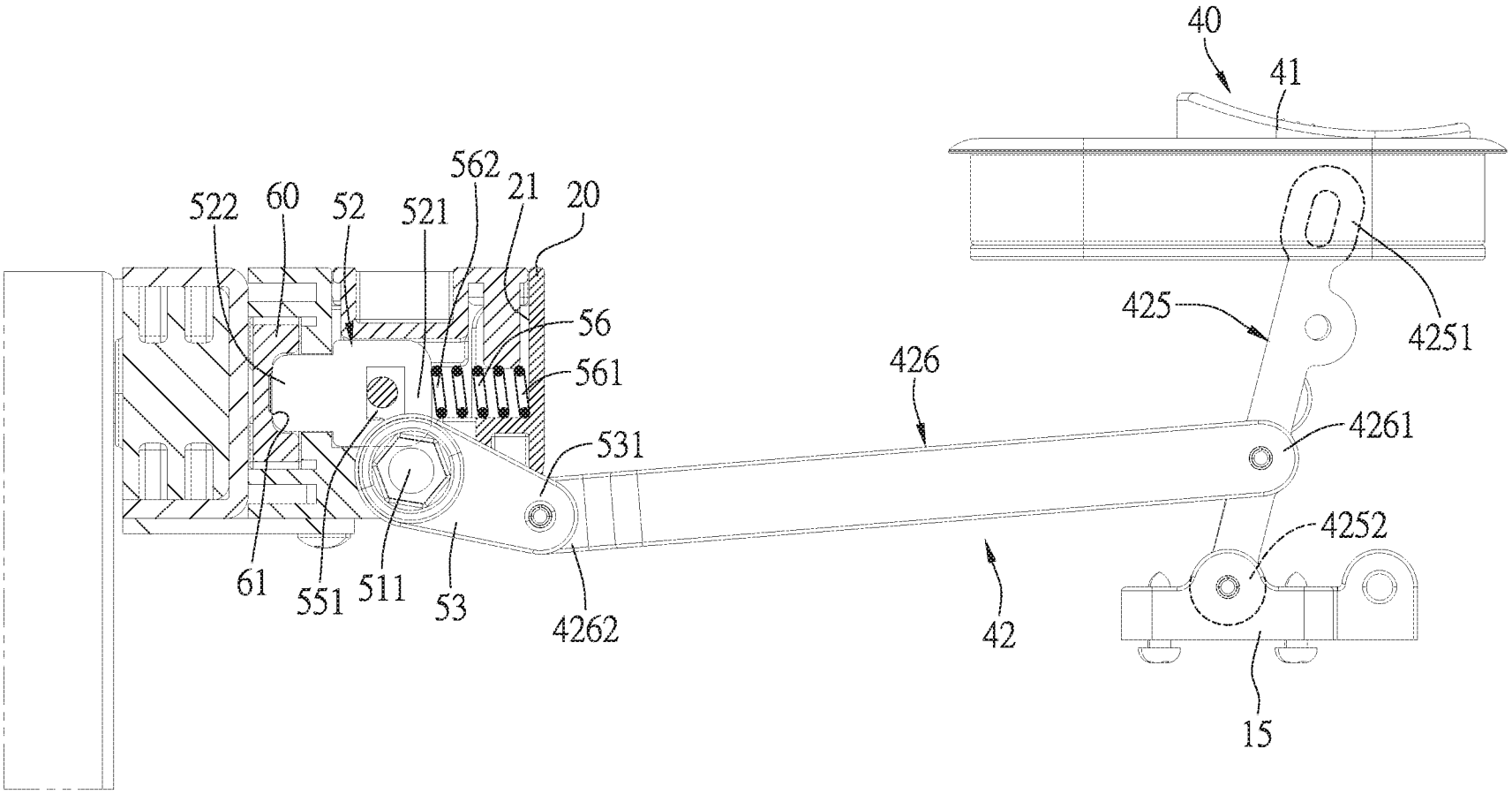
FIG. 19 is a schematic diagram of the operation of the second embodiment of the present invention, showing a state of the adjusting member of a group in the first position and the locking member of the group in the locking position.

The two locking members 52 are pivotally disposed to the second rod portion 512 and capable of moving between a releasing position (FIG. 10) and a locking position (FIG. 9). In this embodiment, each of the locking members 52 includes a first end 521 pivotally disposed to the rear eccentric portion 551, and a second end 522 opposite to the first end 521. It is worth mentioning that the transmission rod 51 can be returned to its original position by a second spring 56 after rotating, that is, the second spring 56 includes a first restoring end 561 fixed to the limiting seat 20, and a second restoring end 562 eccentrically fixed to the transmission rod 51. In this embodiment, the second restoring end 562 is hooked to the middle eccentric portion 541 of the middle eccentric block 54, whereby when the adjustment unit 40 drives the transmission rod 51 to rotate in a first direction (e.g. clockwise) by an angle, the second spring 56 is stretched to provide the restoring force to the transmission rod 51 for returning the transmission rod 51 to its original position.

The positioning member 60 is disposed on the bottom surface 12 of the tabletop 10 and can move along the horizontal direction X relative to the tabletop 10 while the tabletop 10 moves along the longitudinal direction Y relative to the base frame 32. The positioning member 60 includes a greater number of positioning grooves 61 than the amount of locking members 52, and the positioning grooves 61 are arranged along the horizontal direction X and used for inserting or detaching of the second ends 522 of the locking members 52. In this embodiment, the positioning member 60 is movably disposed in the receiving groove 21 of the limiting seat 20, and the connecting rod 37 arranged to the first support frame 34 passes through the positioning member 60. Accordingly, when the height of the table structure changes as the tabletop 10 moves in the longitudinal direction Y, the angle of the first support frame 34 relative to the second support frame 35 also changes; and when the first upper support end 342 of the first support frame 34 slides, the connecting rod 37 is driven to move together with the first upper support end 342, so that the positioning member 60 is driven by the connecting rod 37 to move along the horizontal direction X of the tabletop 10.

Accordingly, to adjust the height of the table structure, the user can push the adjustment member 41 to move from the first position (FIG. 7) to the second position (FIG. 8). At this time, the adjustment unit 40 drives the transmission rod 51 to rotate in a first direction (e.g. a clockwise direction) by an angle. The transmission rod 51 rotated in the first direction causes the second spring 56 to accumulate an elastic restoring force, and the locking members 52 to move from the locking position (FIG. 9) to the releasing position (FIG. 10) to allow the second ends 522 of the locking members 52 to be disengaged from the positioning grooves 61 of the positioning member 60, so that the height of the table structure can be adjusted. During the displacement of the tabletop 10 in the longitudinal direction Y for the adjustment of the height of the table structure, the positioning member 60 is driven by the connecting rod 37 of the first support frame 34 to move relative to the locking member 52 in the horizontal direction X. After the height of the table structure is adjusted in position, the user releases the adjustment member 41, so that the second spring 56 makes the transmission rod 51 rotate in a second direction (e.g. a counterclockwise direction), opposite to the first direction, by an angle, leading to the movement of the adjustment member 41 from the second position (FIG. 8) to the first position (FIG. 7), and the movement of the locking members 52 from the releasing position (FIG. 10) to the locking position (FIG. 9). Therefore, the second ends 522 of the locking members 52 are driven to be inserted into the positioning grooves 61 of the positioning member 60 again, so as to position the tabletop 10.

It can be seen that the present invention provides a height-adjustable table structure, which is characterized in that the adjustment member 41 passes through the top surface 11 of the tabletop 10 for the user to observe, so that the user can clearly see the position of the adjustment member 41. This brings in more intuitive use, achieving the purpose of easy operation and improved safety.

Referring to FIGS. 14-24, the second embodiment of the present invention provides a height-adjustable table structure, which is different from the first embodiment in that there are two groups, each including a limiting seat 20, an adjustment unit 40, a linkage group 50 and a positioning member 60, in the height-adjustable table structure in the second embodiment, and the two groups are the same in structure but different in size.

The two limiting seats 20 are disposed on the bottom surface 12 of the tabletop 10, and are respectively located on two sides of the first support frame 34 and respectively located two sides of the second support frame 35. The two limiting seats 20 have the same structure but different sizes.

Figure 20:
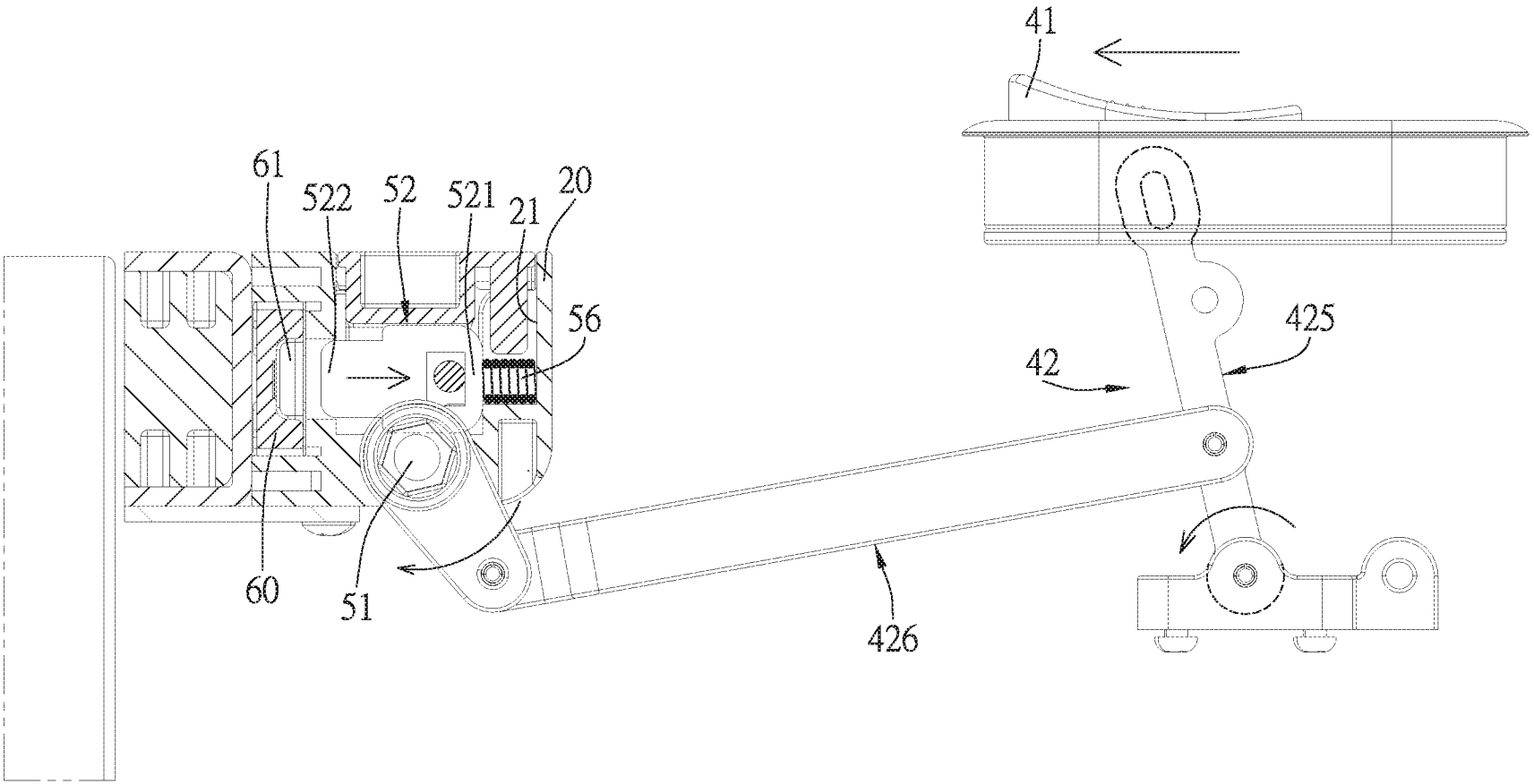
FIG. 20 is a schematic diagram of the operation of the second embodiment of the present invention, showing a state of the adjustment member of the group in the second position and the locking member of the group in the releasing position.
Figure 21:
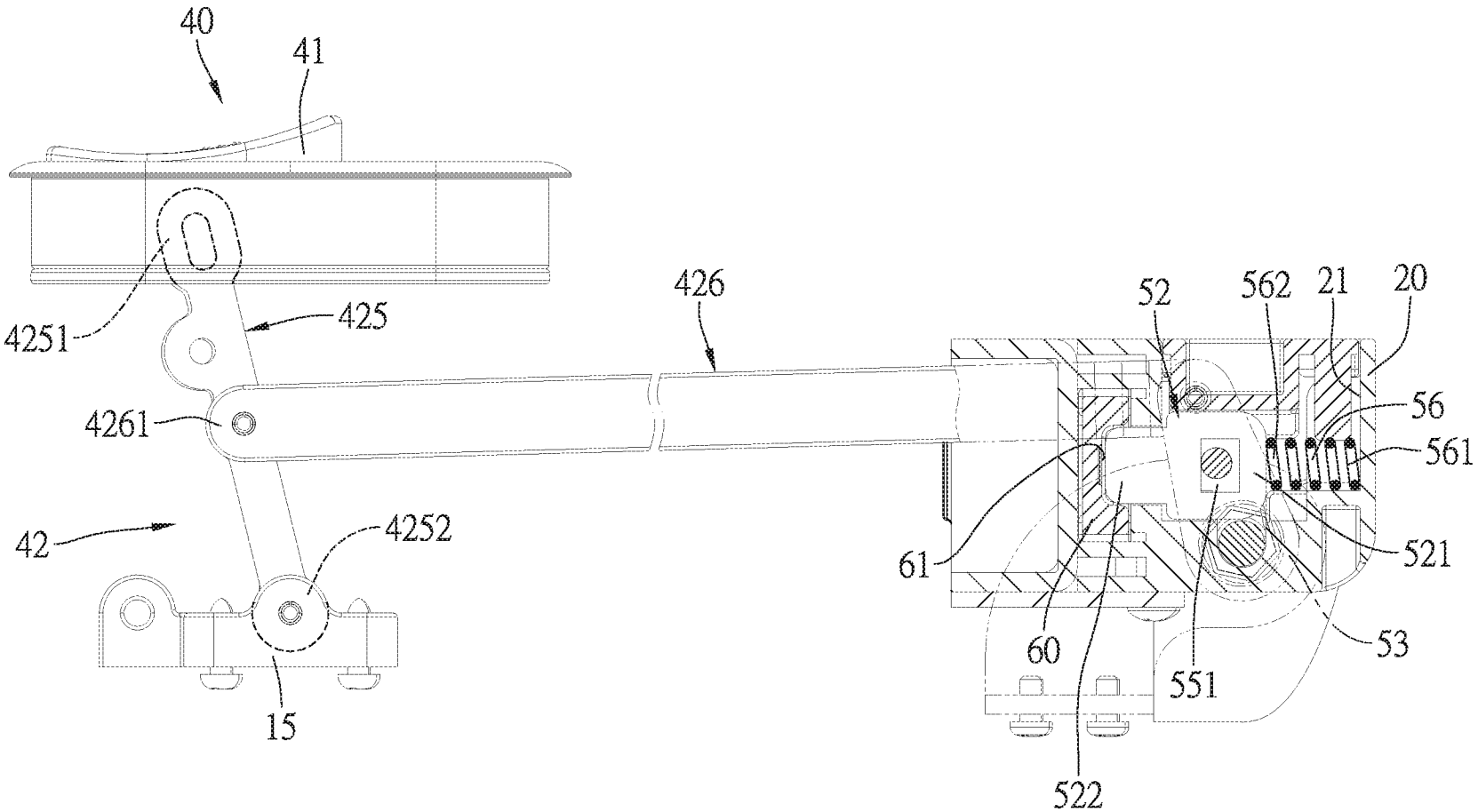
FIG. 21 is a schematic diagram of the operation of the second embodiment of the present invention, showing the state of the adjusting member of another group in the first position and the locking member of the another group in the locking position.
Figure 22:
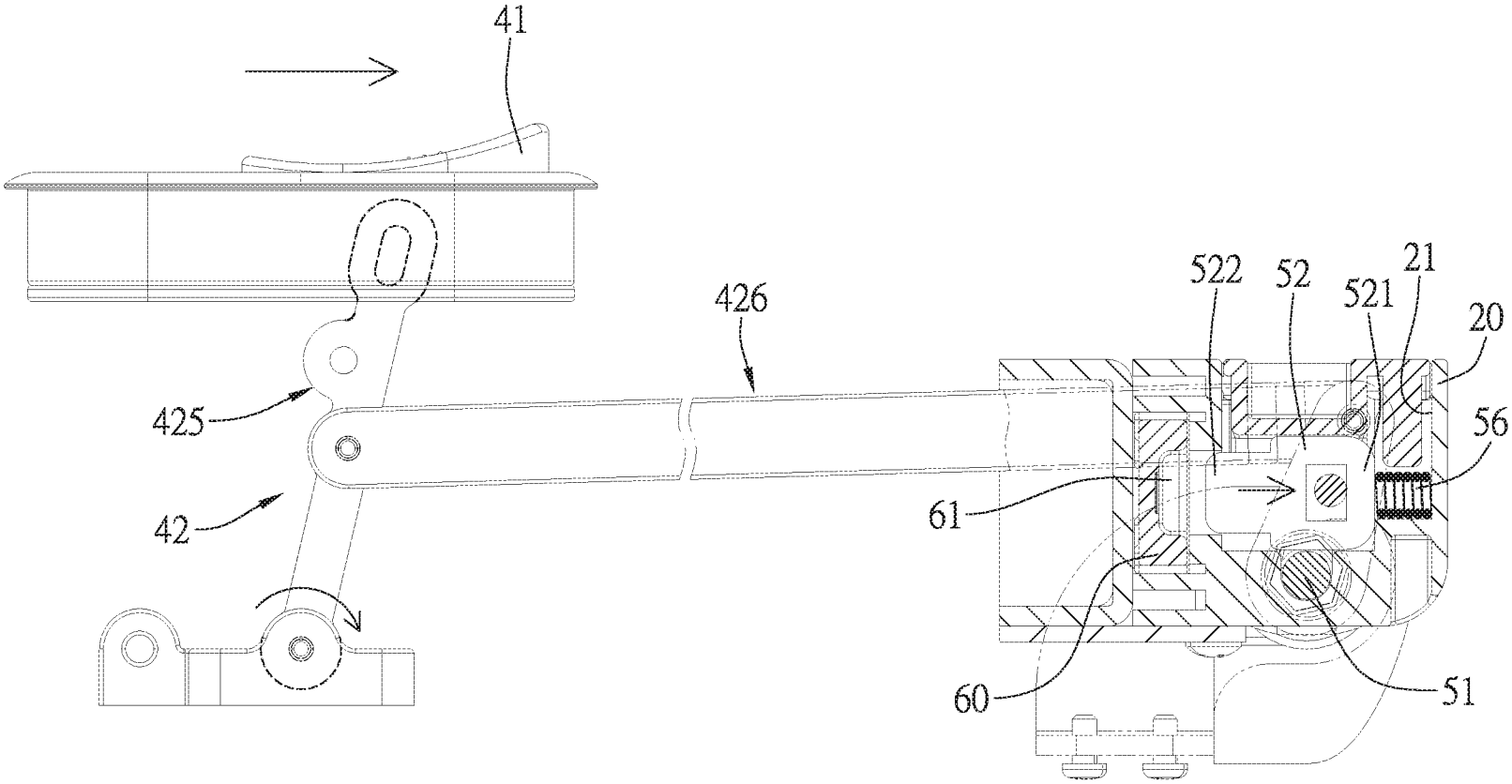
FIG. 22 is a schematic diagram of the operation of the second embodiment of the present invention, showing the state of the adjusting member of the another group in the second position and the locking member of the another group in the releasing position.
Figure 23:
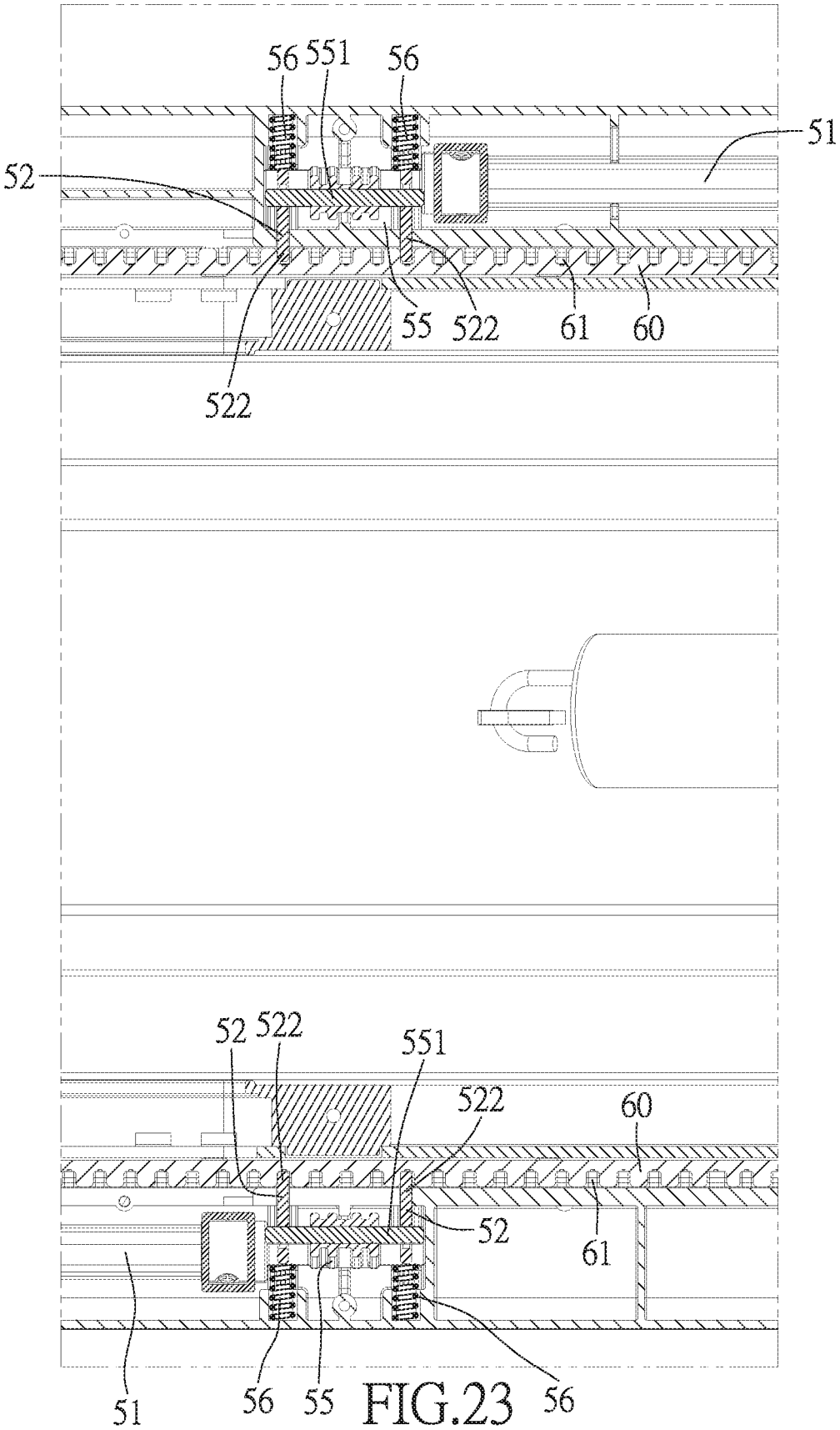
FIG. 23 is a schematic diagram of the operation of the second embodiment of the present invention, showing the state of the locking members of the two groups in the locking position.
Figure 24:
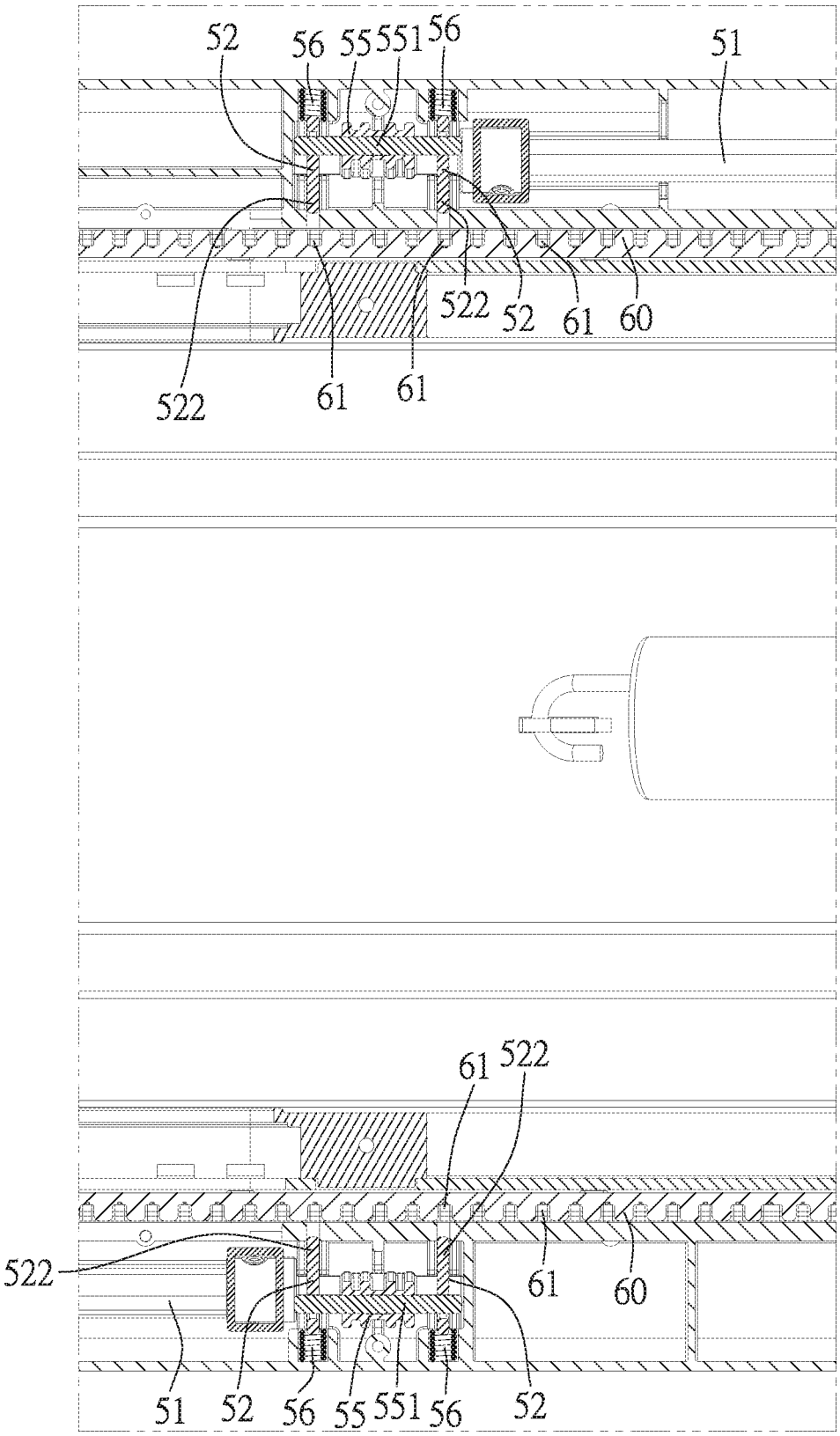
FIG. 24 is a schematic diagram of the operation of the second embodiment of the present invention, showing the state of the locking members of the two groups in the releasing position.

The two adjustment units 40 are disposed on two sides of the tabletop 10 respectively. The two adjustment units 40 have the same structure but different sizes. Each of the adjustment units 40 includes: an adjustment member 41 penetrating the top surface 11 for a user to observe, and a driven member 42 driven to move by the adjustment member 41. The adjustment member 41 can be moved between a first position (FIGS. 19, 21) and a second position (FIGS. 20, 22). In this embodiment, each of the driven members 42 includes a longitudinal rod 425 and a horizontal rod 426. The longitudinal rod 425 includes a first longitudinal rod portion 4251 connected to the adjustment member 41, and a second longitudinal rod portion 4252 pivotally arranged to the tabletop 10 by a connecting block 14. The horizontal rod 426 includes a first horizontal rod portion 4261 pivotally arranged to the longitudinal rod 425, and a second horizontal rod portion 4262 eccentrically connected to the first rod portion 511 of the transmission rod 51.

The two linkage groups 50 are disposed on two sides of the bottom surface 12 of the tabletop 10 respectively, and each includes a transmission rod 51 and two locking members 52. Each of the transmission rod 51 is rotatably disposed on the bottom surface 12 of the tabletop 10 and capable of returning to its original position, and includes: a first rod portion 511 connected to and driven to move by a corresponding one of the driven members 42, and a second rod portion 512. In this embodiment, the first rod portion 511 is provided with a front eccentric block 53 which is fixed thereto and has a front eccentric portion 531. The front eccentric portion 531 is not on an axis of the transmission rod 51, and is drivingly connected to the second horizontal rod portion 4262 of the horizontal rod 426, so that the transmission rod 51 can be driven by the adjustment unit 40 to rotate by an angle. The second rod portion 512 of the transmission rod 51 is provided in the receiving groove 21 of the corresponding limiting seat 20, and is provided with a rear eccentric block 55 including a rear eccentric portion 551 which is not on the axis of the transmission rod 51. The two locking members 52 are disposed in the receiving grooves 21 of the limiting seats 20, and each includes a first end 521 eccentrically and pivotally arranged to the second rod portion 512, and a second end 522 to be inserted into or disengaged from the positioning grooves 61. That is, the first end 521 of each locking member 52 is connected to the rear eccentric portion 551 of the rear eccentric block 55, so that the transmission rod 51 can drive the locking members 52 to move by rotating by an angle. In this embodiment, the transmission rods 51 can be returned to its original position by the two second springs 56 after rotating, that is, each of the second springs 56 includes a first restoring end 561 fixed to an inner surface of a corresponding one of the receiving grooves 21, and a second restoring end 562 that pushes against the first end 521 of a corresponding one of the locking members 52. When each of the driven members 42 drives a corresponding one of the transmission rods 51 to rotate in a first direction (e.g. a clockwise direction) by an angle, the corresponding second spring 56 is compressed and provides a restoring force to the corresponding transmission rod 51 so that the transmission rod 51 is driven to rotate for returning to its original position. In the present invention, the number of second springs 56 configured to cooperate with the locking member 52 is not limited to two, and in this embodiment or other embodiments, the number of second springs 56 configured to cooperate with the locking member 52 can be one or more than one, as long as the locking member 52 driven to move can return to its original position.

Each of the two positioning members 60 is movably disposed in the receiving groove 21 of a corresponding limiting seat 20 of the limiting seats 20, and the connecting rod 37 of the first support frame 34 is inserted in both of the two positioning member 60. Therefore, the connecting rod 37 assembled to the first support frame 34 simultaneously drives the two positioning members 60 to move along the horizontal direction X in their respective limiting seats 20.

The adjustment method of the second embodiment is substantially the same as that of the first embodiment, except that the connecting rod 37 assembled to the first support frame 34 simultaneously drives the two positioning members 60 to move along the horizontal direction X in their respective limiting seats 20, and the two positioning members 60 are respectively locked by the two driven members 42. Therefore, to adjust the height of the table structure, the user needs to simultaneously control the adjustment members 41 of the two adjustment units 40 to move the corresponding locking members 52 to the respective releasing positions (FIGS. 20 and 22) to unlock the two positioning members 60 at the same time, and then the height of the table structure can be adjusted. Similarly, to position the tabletop 10 adjusted in position already, the two locking members 52 need to be moved to the locking positions respectively (FIGS. 19 and 21), so as to lock the two positioning members 60 at the same time, and then, the height of the table structure can be maintained.

While we have shown and described various embodiments in accordance with the present invention, it is clear to those skilled in the art that further embodiments may be made without departing from the scope of the present invention.

What is claimed is:

1. A height-adjustable table structure comprising:

a tabletop comprising a top surface and a bottom surface opposite to the top surface;

at least one adjustment unit disposed to the tabletop, and including: an adjustment member penetrating the top surface for a user to observe, and a driven member driven to move by the adjustment member, wherein the adjustment member is movable between a first position and a second position, the driven member of the at least one adjustment unit includes: a first portion connected to the adjustment member, a second portion pivotally arranged to the bottom surface of the tabletop, and a third portion located between the first portion and the second portion;

at least one linkage group disposed on the bottom surface of the tabletop, and including: a transmission rod and at least one locking member, wherein the transmission rod is rotatably disposed on the bottom surface of the tabletop and capable of returning to its original position, and includes: a first rod portion eccentrically connected to the third portion of the driven member and driven to move by the driven member, and a second rod portion, and the at least one locking member is pivotally arranged to the second rod portion and capable of moving between a releasing position and a locking position;

at least one positioning member disposed on the bottom surface of the tabletop and movable along a horizontal direction relative to the tabletop while the tabletop moves along a longitudinal direction relative to a base frame, wherein the at least one positioning member comprises a greater number of positioning grooves than that of the locking members, and the positioning grooves are used for inserting or detaching of the at least one locking member;

a limiting seat fixed to the bottom surface of the tabletop to allow the at least one positioning member to be movable along the horizontal direction of the tabletop;

two upper sliding seats fixed to the bottom surface of the tabletop and respectively located at two sides of the limiting seat;

the base frame located below the bottom surface of the tabletop;

two lower sliding seats fixed to two sides of the base frame respectively;

a first support frame including a first lower support end pivotally disposed to the base frame, and a first upper support end slidably disposed to the two upper sliding seats to drive the at least one positioning member to move along the horizontal direction of the tabletop;

a second support frame pivotally arranged to the first support frame and including a second upper support end pivotally disposed to the bottom surface of the tabletop, and a second lower support end slidably disposed to the two lower sliding seats;

at least one first spring including a first extension end arranged to the first upper support end of the first support frame, and a second extension end configured to be fixed to the bottom surface of the tabletop; and a second spring including a first restoring end fixed to the limiting seat, and a second restoring end eccentrically fixed to the transmission rod, wherein when the at least one adjustment unit drives the transmission rod to rotate in the first direction by an angle, the second spring is stretched to accumulate a restoring force for the transmission rod;

when the adjustment member moves from the first position to the second position, the adjustment unit drives the transmission rod to rotate in a first direction by an angle and accumulates a restoring force, and also drives the at least one locking member to move from the locking position to the releasing position to allow the at least one locking member to be disengaged from the positioning grooves of the at least one positioning member; and then, while the tabletop moves in the longitudinal direction relative to the base frame, the at least one positioning member moves relative to the at least one locking member in the horizontal direction, and when the adjustment member is released, the transmission rod is driven by the restoring force to rotate in a second direction opposite to the first direction by an angle, so that the adjustment member is moved from the second position to the first position, and the at least one locking member is moved from the releasing position to the locking position, enabling the at least one locking member to be inserted into the positioning grooves of the at least one positioning member.

2. The height-adjustable table structure as claimed in claim 1, wherein the first rod portion of the transmission rod is provided with a front eccentric block which comprises a front eccentric portion, and the third portion of the adjustment member is connected to the front eccentric portion.

3. The height-adjustable table structure as claimed in claim 1, wherein the transmission rod is provided with a middle eccentric block comprising a middle eccentric portion, and the second restoring end of the second spring is fixed to the middle eccentric portion.

4. The height-adjustable table structure as claimed in claim 1, wherein the at least one locking member comprises a first end eccentrically and pivotally arranged to the second rod portion, and a second end configured to be inserted to or disengaged from the positioning grooves.

5. The height-adjustable table structure as claimed in claim 4, wherein the second rod portion of the transmission rod is provided with a rear eccentric block comprising a rear eccentric portion, and the first end of the at least one locking member pivotally arranged to the rear eccentric portion.

6. A height-adjustable table structure comprising:

a tabletop comprising a top surface and a bottom surface opposite to the top surface;

at least one adjustment unit disposed to the tabletop, and including: an adjustment member penetrating the top surface for a user to observe, and a driven member driven to move by the adjustment member, wherein the adjustment member is movable between a first position and a second position, the driven member of the at least one adjustment unit includes a longitudinal rod and a horizontal rod, the longitudinal rod comprises a first longitudinal rod portion connected to the adjustment member, and a second longitudinal rod portion pivotally arranged to the tabletop, the horizontal rod comprises a first horizontal rod portion pivotally arranged to the longitudinal rod and a second horizontal rod portion;

at least one linkage group disposed on the bottom surface of the tabletop, and including: a transmission rod and at least one locking member, wherein the transmission rod is rotatably disposed on the bottom surface of the tabletop and capable of returning to its original position, and includes: a first rod portion eccentrically connected to the second horizontal rod of the driven member and driven to move by the driven member, and a second rod portion, and the at least one locking member is pivotally arranged to the second rod portion and capable of moving between a releasing position and a locking position;

at least one positioning member disposed on the bottom surface of the tabletop and movable along a horizontal direction relative to the tabletop while the tabletop moves along a longitudinal direction relative to a base frame, wherein the at least one positioning member comprises a greater number of positioning grooves than that of the locking members, and the positioning grooves are used for inserting or detaching of the at least one locking member;

a limiting seat fixed to the bottom surface of the tabletop to allow the at least one positioning member to be movable along the horizontal direction of the tabletop;

two upper sliding seats fixed to the bottom surface of the tabletop and respectively located at two sides of the limiting seat;

the base frame located below the bottom surface of the tabletop;

two lower sliding seats fixed to two sides of the base frame respectively;

a first support frame including a first lower support end pivotally disposed to the base frame, and a first upper support end slidably disposed to the two upper sliding seats to drive the at least one positioning member to move along the horizontal direction of the tabletop;

a second support frame pivotally arranged to the first support frame and including a second upper support end pivotally disposed to the bottom surface of the tabletop, and a second lower support end slidably disposed to the two lower sliding seats;

at least one first spring including a first extension end arranged to the first upper support end of the first support frame, and a second extension end configured to be fixed to the bottom surface of the tabletop; and at least one second spring, wherein the limiting seat comprises a receiving groove, the second rod portion of the transmission rod and the at least one locking member are disposed to the receiving groove, the at least one locking member comprises a first end eccentrically and pivotally arranged to the second rod portion, and a second end arranged to be inserted to or disengaged from the positioning grooves, the at least one second spring comprises a first restoring end fixed to an inner surface of the receiving groove, and a second restoring end configured to push against the first end of the at least one locking member, and when the at least one adjustment unit drives the transmission rod to rotate in the first direction by an angle, the at least one second spring is compressed to accumulate a restoring force for the transmission rod;

when the adjustment member moves from the first position to the second position, the adjustment unit drives the transmission rod to rotate in a first direction by an angle and accumulates a restoring force, and also drives the at least one locking member to move from the locking position to the releasing position to allow the at least one locking member to be disengaged from the positioning grooves of the at least one positioning member; and then, while the tabletop moves in the longitudinal direction relative to the base frame, the at least one positioning member moves relative to the at least one locking member in the horizontal direction, and when the adjustment member is released, the transmission rod is driven by the restoring force to rotate in a second direction opposite to the first direction by an angle, so that the adjustment member is moved from the second position to the first position, and the at least one locking member is moved from the releasing position to the locking position, enabling the at least one locking member to be inserted into the positioning grooves of the at least one positioning member.

7. The height-adjustable table structure as claimed in claim 6, wherein the first rod portion of the transmission rod is provided with a front eccentric block comprising a front eccentric portion, and the second horizontal rod portion of the horizontal rod is connected to the front eccentric portion.

8. The height-adjustable table structure as claimed in claim 6, wherein the second rod portion of the transmission rod is provided with a rear eccentric block comprising a rear eccentric portion, and the first end of the at least one locking member is pivotally arranged to the rear eccentric portion.

* * * * *